US010662893B1

(12) United States Patent
Powell et al.

(10) Patent No.: US 10,662,893 B1
(45) Date of Patent: May 26, 2020

(54) OPPOSED PISTON ENGINE WITH IMPROVED PISTON SURFACES

(71) Applicant: Warren Engine Company, Inc., Alexandria, VA (US)

(72) Inventors: Gregory B. Powell, Rockville, MD (US); James C. Warren, Alexandria, VA (US)

(73) Assignee: Warren Engine Company, Inc, Alexandria, VA (US)

( * ) Notice: Subject to any disclaimer, the term of this patent is extended or adjusted under 35 U.S.C. 154(b) by 0 days.

(21) Appl. No.: 15/650,844

(22) Filed: Jul. 14, 2017

Related U.S. Application Data

(60) Provisional application No. 62/362,244, filed on Jul. 14, 2016.

(51) Int. Cl.

| | |
|---|---|
| ***F02F 3/26*** | (2006.01) |
| ***F02B 75/02*** | (2006.01) |
| ***F02B 75/28*** | (2006.01) |
| ***F02P 15/00*** | (2006.01) |
| ***F02P 15/02*** | (2006.01) |

(52) U.S. Cl.
CPC ..... *F02F 3/26* (2013.01); *F02B 75/02* (2013.01); *F02B 75/282* (2013.01); *F02P 15/001* (2013.01); *F02P 15/02* (2013.01); *F02B 2075/027* (2013.01)

(58) Field of Classification Search
CPC ..... F02F 3/26; F02B 75/02; F02B 75/282; F02B 2075/027; F02P 15/001; F02P 15/02
See application file for complete search history.

(56) References Cited

U.S. PATENT DOCUMENTS

| | | | | |
|---|---|---|---|---|
| 6,250,263 | B1 * | 6/2001 | Sisco | F01B 7/14 123/51 BA |
| 8,783,218 | B2 * | 7/2014 | Shen | F02B 23/0675 123/51 R |
| 9,708,976 | B1 * | 7/2017 | Warren | F02B 75/00 |
| 2010/0282219 | A1 * | 11/2010 | Alonso | F01B 3/10 123/51 AA |
| 2012/0031379 | A1 * | 2/2012 | Zhou | F01B 9/042 123/51 R |
| 2016/0290224 | A1 * | 10/2016 | Abani | F02B 75/02 |

* cited by examiner

*Primary Examiner* — Lindsay M Low
*Assistant Examiner* — Ruben Picon-Feliciano
(74) *Attorney, Agent, or Firm* — Capitol Patent & Trademark Law Firm, PLLC

(57) ABSTRACT

An opposed-piston engine contains opposed pistons wherein each piston has a piston face containing a recess. The recesses formed in the piston faces define a combustion chamber when contained within a cylinder. An ignition system is at least partially contained within the combustion chamber to enhance the combustion efficiency of a fuel-air mixture within the combustion system.

7 Claims, 22 Drawing Sheets

OPPOSED PISTON ENGINE WITH IMPROVED PISTON SURFACES

CROSS-REFERENCE TO RELATED APPLICATIONS

This application claims the benefit of U.S. Provisional Patent Application Ser. No. 62/362,244 filed on Jul. 14, 2016, the teachings of which are herein incorporated by reference.

TECHNICAL FIELD

The present invention relates generally to improvements for an opposed-piston engine, and preferably a four-stroke engine, including forming recesses or asymmetric shapes in the piston faces to thereby tailor a combustion chamber volume therein.

BACKGROUND OF THE INVENTION

A continuing challenge is to optimize the power and fuel economy of a four-stroke opposed-piston engine. A related challenge is to reliably ignite a fuel-air mixture within a combustion chamber within a four-stroke opposed-piston engine. Historically, increasing the relative power of an opposed piston engine has been restrained by the fact that most, if not all, earlier designs of opposed piston engines were two-stroke engines. Recent advents in the design of opposed-piston engine technology includes providing four-stroke technology in context with the opposed-piston combustion chamber design. One related challenge has been to increase the combustion chamber volume to thereby increase the fuel-air mixture and as such, increase the power output produced upon combustion. To that end, it is critical that the combustion chamber realize increased fuel-air mixtures, along with enhanced means to ignite this mixture.

SUMMARY OF THE INVENTION

In accordance with the present invention, an opposed-piston engine contains at least one cylinder. A preferred embodiment contains a four-stroke opposed-piston engine. A first piston and a second piston opposed to the first piston are each contained within the cylinder, wherein the first piston contains a first piston face containing a first recess, and the second piston contains a second shaped piston face containing a second recess. A combustion chamber within the engine is defined by the first piston face and the second piston face in opposition to the first piston face, within the cylinder. In one embodiment, the opposed-piston engine contains at least one intake valve and at least one exhaust valve in fluid communication with the aforementioned combustion chamber. In one embodiment, the opposed-piston engine may include an ignition system at least partially contained within the aforementioned combustion chamber. In yet another embodiment, the opposed-piston engine may contain an ignition system that contains at least one spark plug at least partially contained within the first recess; if desired, a second spark plug may be at least partially contained within the second recess.

DETAILED DESCRIPTION OF THE INVENTION

Figure 1:
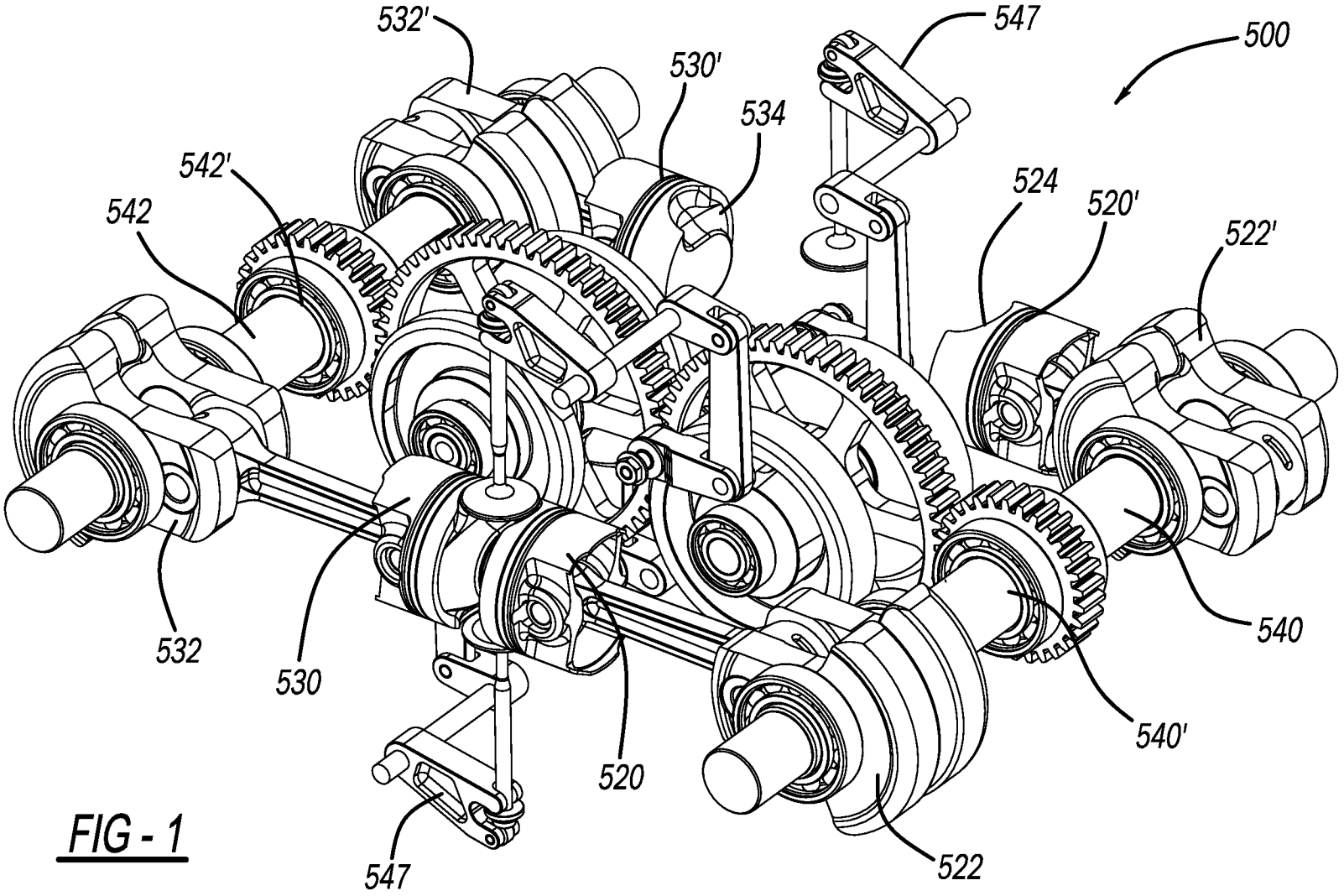
FIG. 1 is a perspective view of a preferred engine, in accordance with the present invention.
Figure 2:
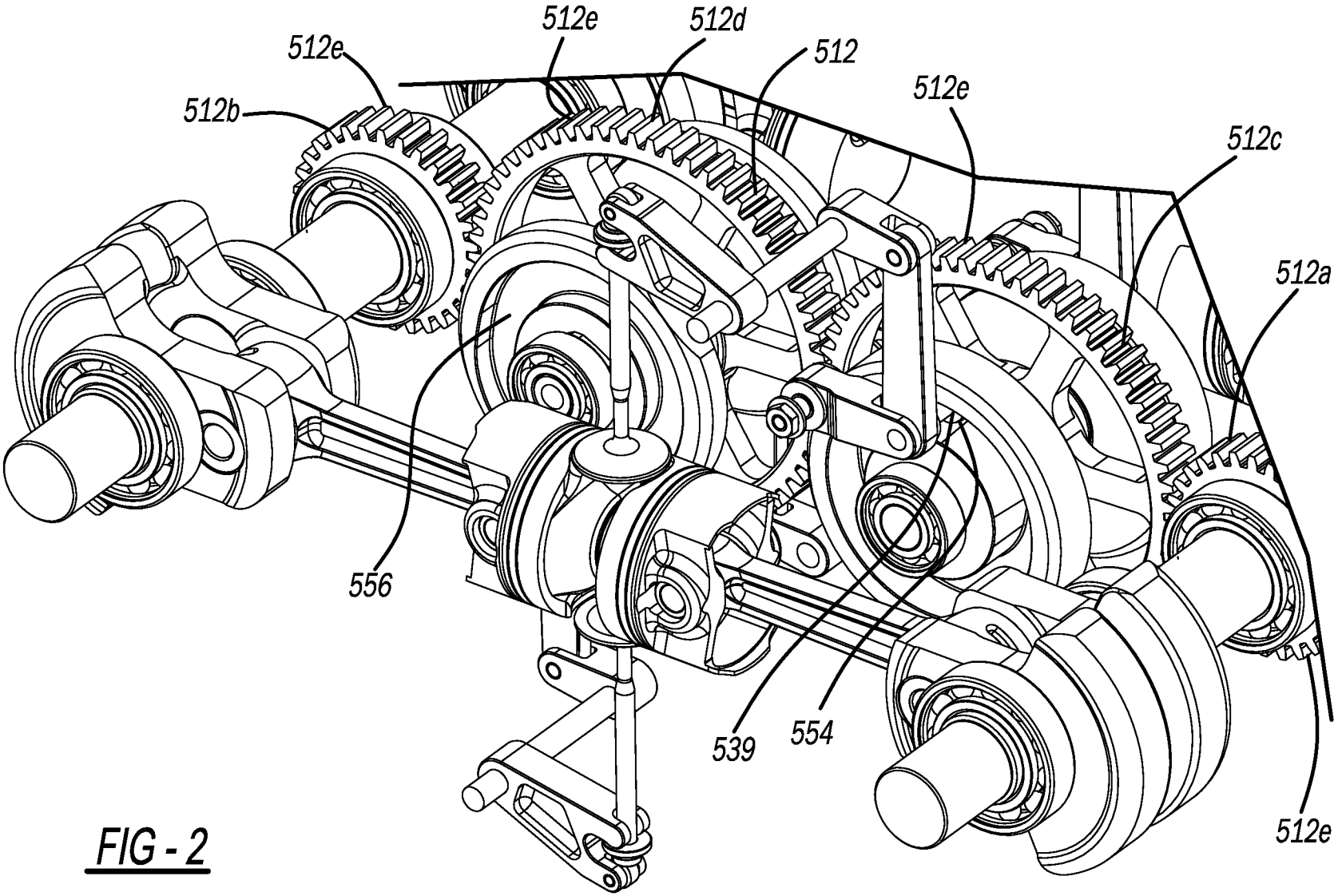
FIG. 2 is a perspective view of a preferred engine, in accordance with the present invention.
Figure 3:
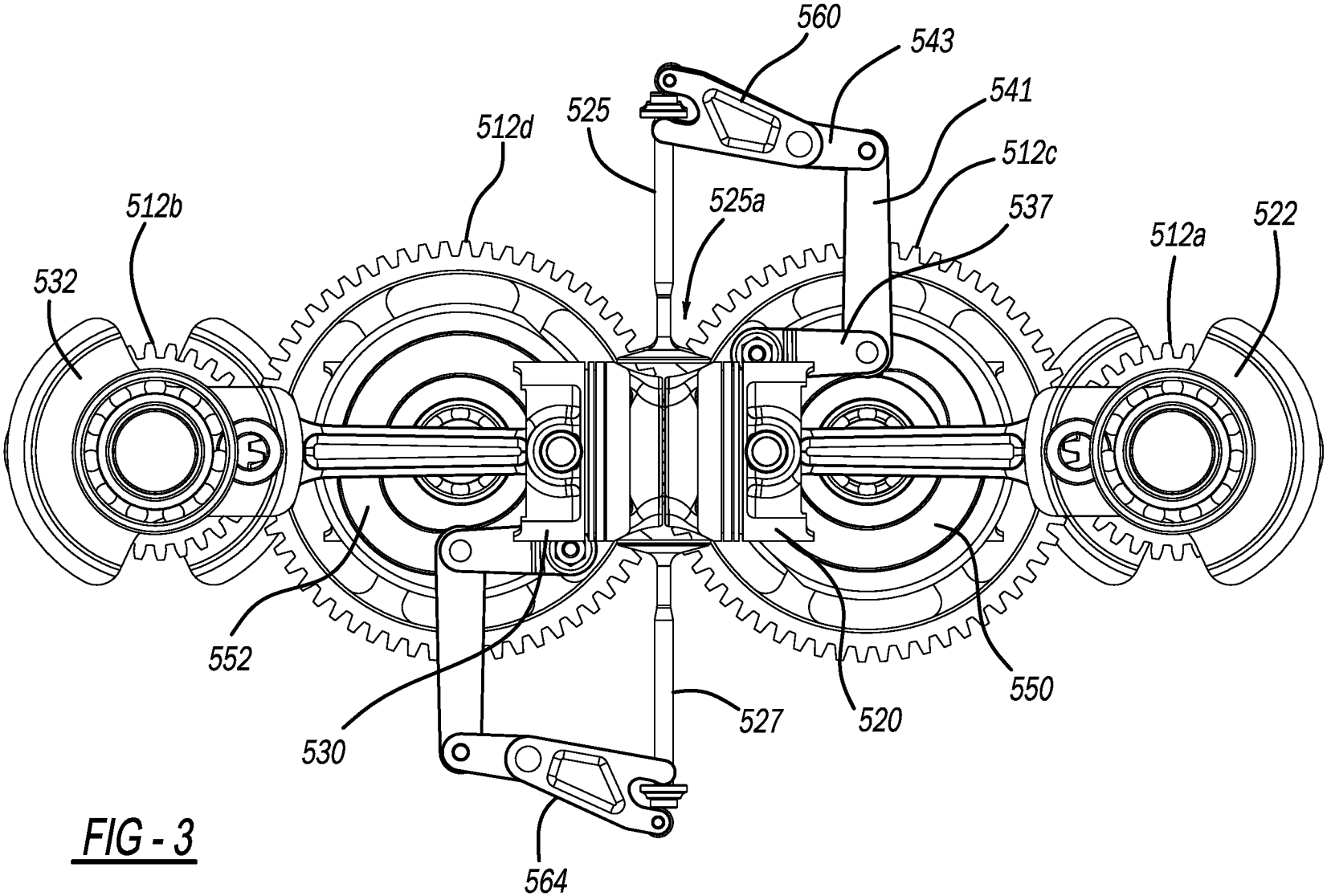
FIG. 3 is a side view of a preferred engine, in accordance with the present invention.
Figure 4:
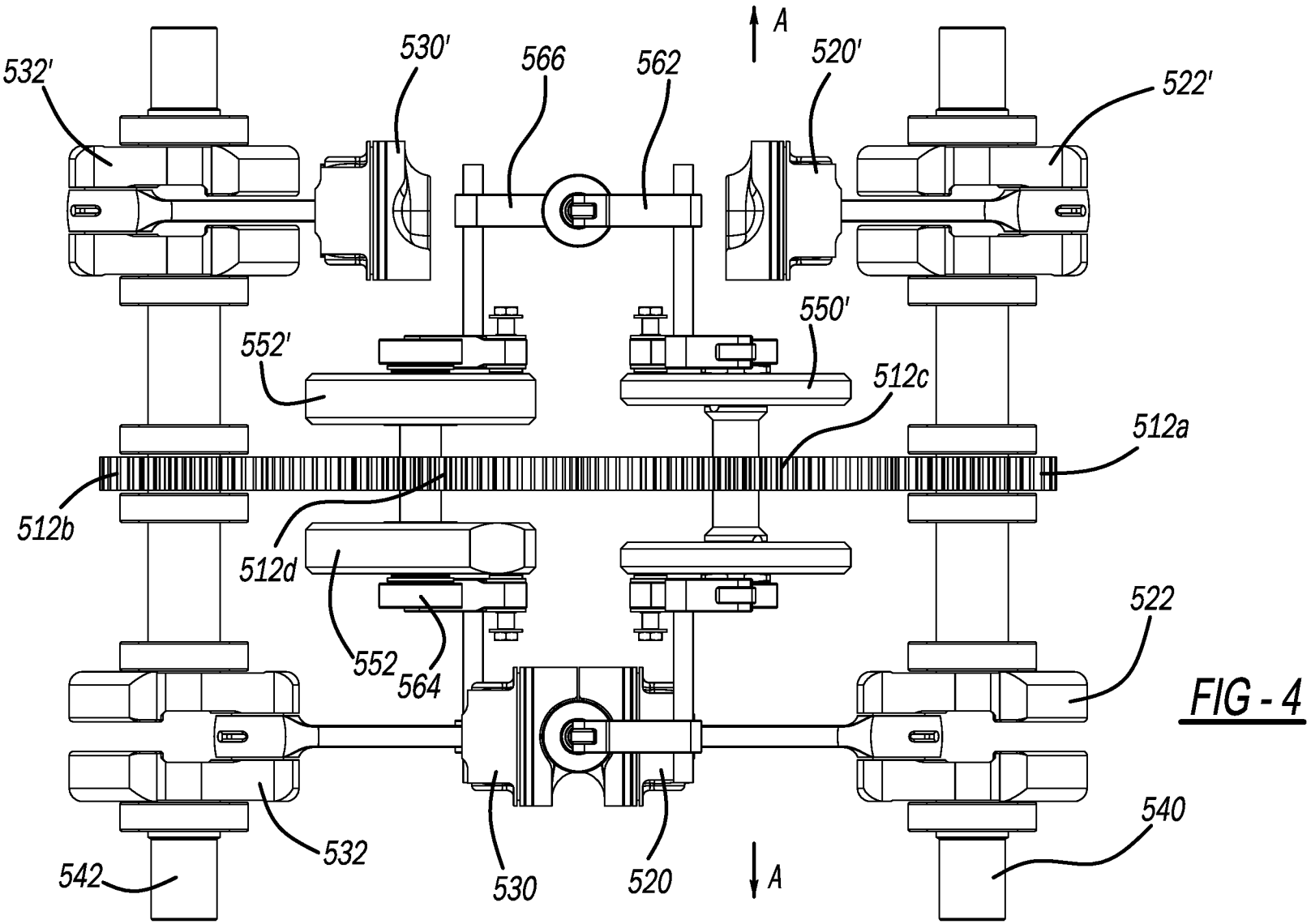
FIG. 4 is a top view of preferred engine, in accordance with the present invention.

The novel aspects of the present invention are presented below. U.S. Pat. Nos. 7,004,120 and 7,779,795, and U.S. patent application Ser. Nos. 13/633,097 and 15/621,711 are related to the present invention, the teachings of each of which are herein incorporated by reference in their entireties.

As shown in FIGS. 1-7, for example, an opposed piston engine 500 contains an engine housing (not shown) containing a first cylinder 510 and a second cylinder 510'. A first pair of opposed pistons 520 and 530 are housed within the first cylinder 510. A second pair of opposed pistons 520' and 530' are housed within the second cylinder 510'. Although discussion is directed to the first cylinder 510 containing pistons 520 and 530, the same discussion is applicable with regard to second cylinder 510' and opposed pistons 520' and 530'.

Referring to the FIGURES, opposed pistons 520 and 530 are connected via respective connecting rods 522 and 532 to respective crankshafts 540 and 542 mounted in engine housing 505 as described in U.S. Pat. No. 7,004,120. Pistons 520 and 530 reciprocate within cylinder 510 to rotate the crankshafts, in a manner known in the art. Each associated crankshaft and/or connecting rod is configured to aid in providing a predetermined stroke length to its associated piston residing within the cylinder. The opposed first and second pistons 520 and 530 may be of a relatively standard design, and may have predetermined lengths and predetermined diameters.

In one embodiment, the stroke length of each of pistons 520 and 530 may be determined to be about 3 inches. Thus, the total difference between the spacing of the pistons at closest approach to each other (i.e., at "top dead center") may range from 0 inches to 0.25 inches, and more preferably from about 0.05 inches to 0.2 inches, and the maximum spacing of the pistons during the engine cycle (i.e., at "bottom dead center") is about 4-7 inches, and more preferably about 6 inches. As will be apparent to one of ordinary skill in the art, these distances may be altered depending on specific design criteria.

If desired, the piston lengths may be adjusted (to substantially equal lengths) for controlling spacing between the piston faces, thereby providing a means for adjusting the compression ratio and generally providing a predetermined degree of compression for heating intake air to facilitate combustion of a fuel injected or otherwise inserted into the combustion chamber. The piston lengths are geometrically determined in accordance with the piston stroke length and the lengths of apertures (described below) formed in the cylinders through which flow exhaust gases and air for combustion. The piston caps 524 and 534 which are exposed to the combustion event may be formed so that when the two piston caps 524 and 534 meet in the center of the cylinder 510 they preferably form a somewhat toroidal, hour-glass-shaped, or otherwise-shaped cavity as the combustion chamber 521, as shown in the Figures. This pistons and piston caps are made from materials known in the art.

Each piston should have a length from the piston fire ring to the cap suitable for keeping the piston rings out of the cylinder opening(s) 510*a*. The piston caps 524 and 534 each have a diameter roughly equal to the interior of the associated cylinder, and may be made of carbon fiber, ceramic, or any other suitable material to aid in minimizing thermal inefficiencies during engine operation.

In an embodiment optionally utilizing a delivery conductor and ground conductor for spark generation (as described in U.S. Pat. No. 7,448,352, the teachings of which are herein incorporated by reference), in addition to the present novel recesses formed within the piston faces, the face of each piston may also include a slot(s) or groove(s) (not shown) formed therein and configured for providing a clearance between the piston face and the delivery and ground conductors, as the pistons approach each other within the cylinder.

Figure 18:
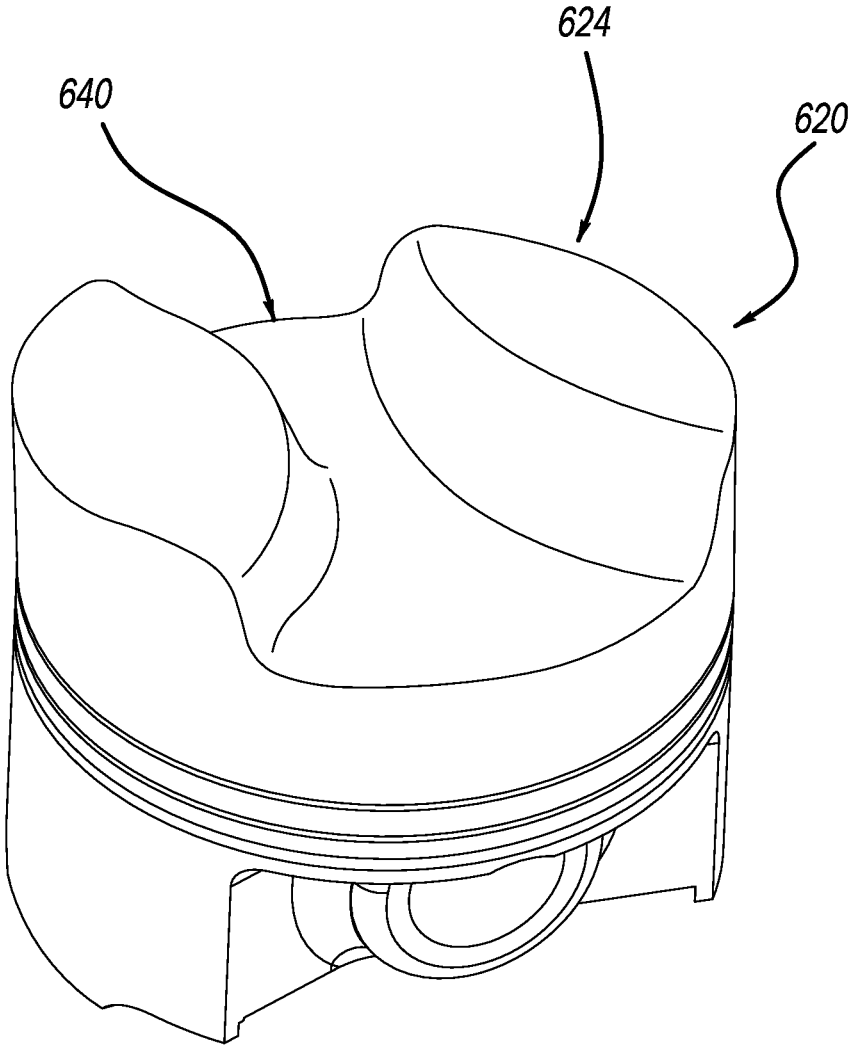
FIG. 18 illustrates an exemplary piston and piston face containing an hour-glass shaped recess.
Figure 19:
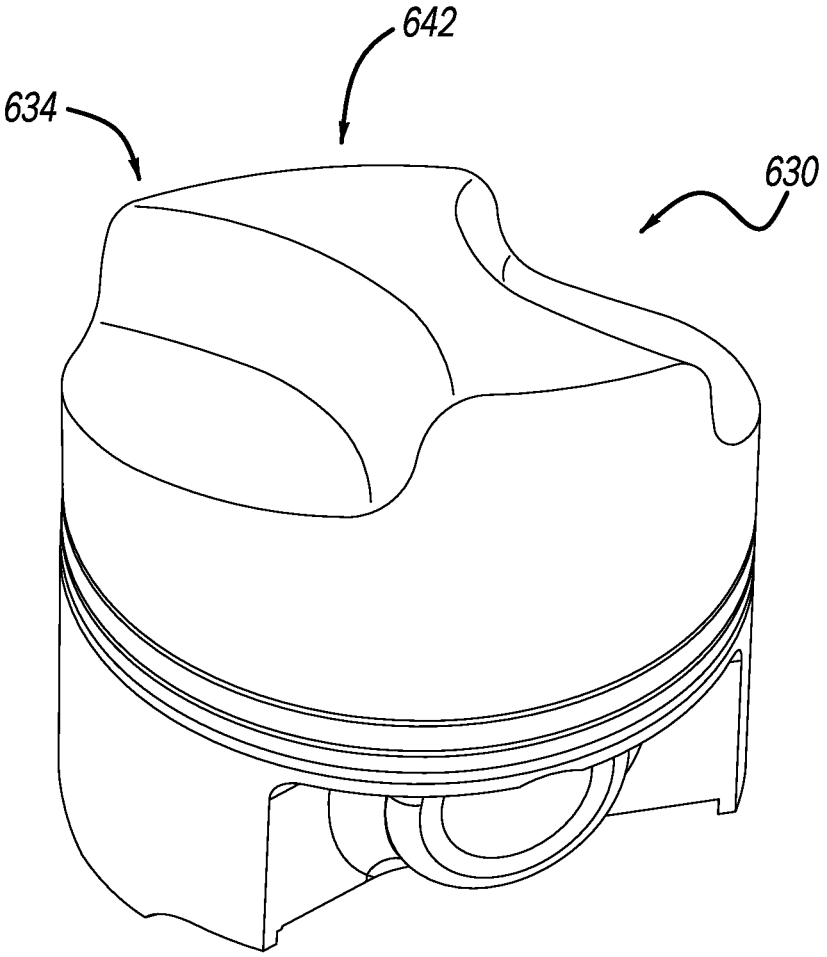
FIG. 19 illustrates an exemplary piston and piston face containing a complementary-shaped recess as compared to FIG. 18, and contains a raised portion that is shaped as an hour-glass.

In yet another aspect of the present invention, the piston face may be contoured to provide certain additional advantages. For example, in one embodiment of a piston 620 shown in FIG. 18, the piston cap or piston face 624 may be shaped to include a first recess 640 or cavity shaped in an hour-glass form. As shown in FIG. 19, an opposed piston 630 may contain a piston surface or piston face 634 and may be shaped to include a raised portion 642 in an hour-glass form that mates with the hour-glass recess when both opposed piston faces are at top dead center (TDC). It will be appreciated that any complementary shapes may be formed pursuant to design requirements.

Figure 21:
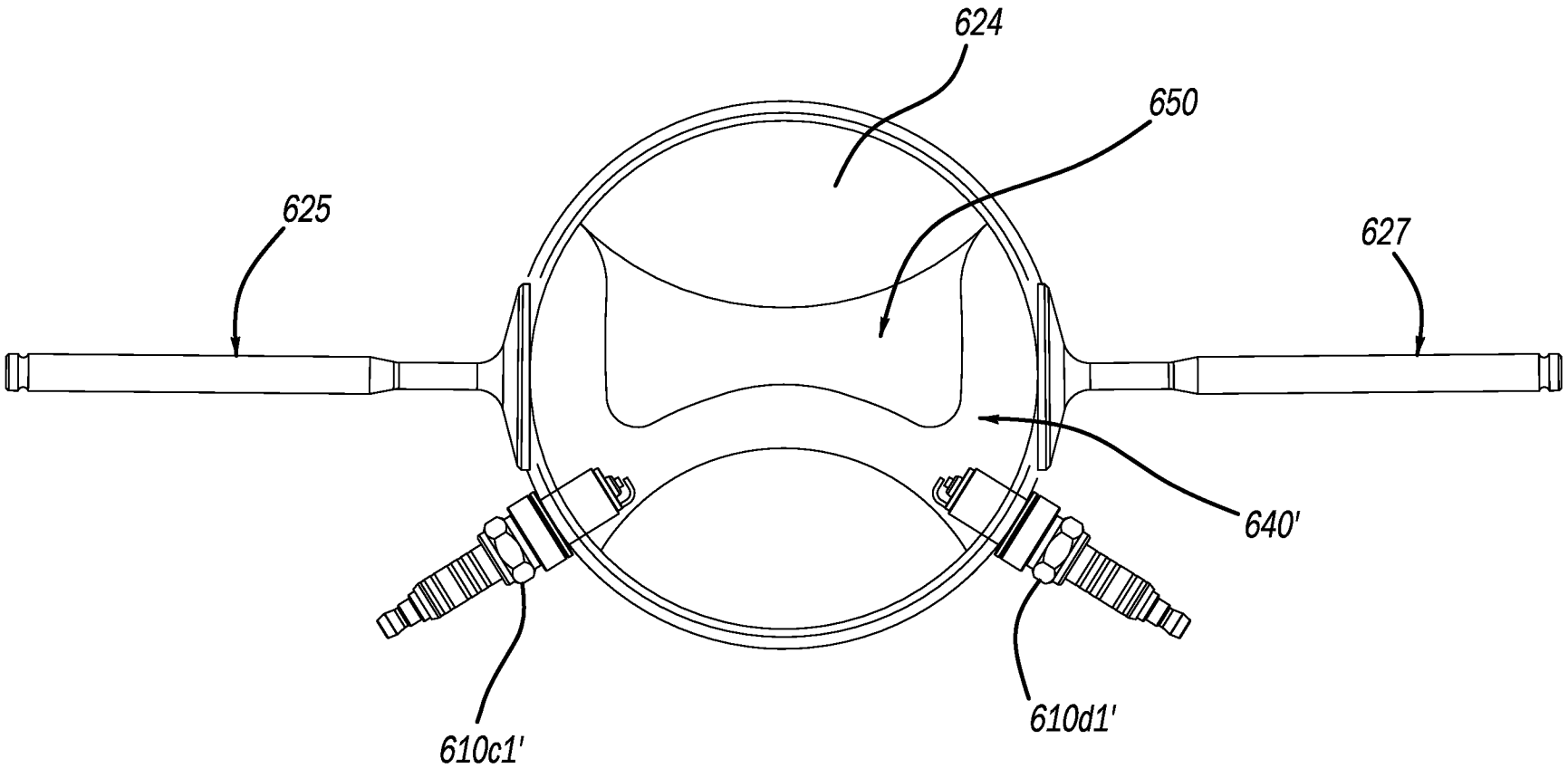
FIG. 21 illustrates an exemplary piston and piston face containing a ridge and a valley, and two spark plugs, each contained within the ridge.

Or, as shown in FIG. 21 for example, a pair of pistons 620 and 630 may be shaped to provide clearance from radially inwardly extending intake and exhaust valves 625 and 627, respectively, when the pistons reach TDC, wherein each piston face may be designed with substantially the same design. Alternatively, the piston surfaces of two opposed pistons may be shaped in male/female or complementary designs to optimize the compression in the resultant combustion chamber as the two opposed pistons reach top dead center, thereby providing an optimal burn to increase the power in the engine.

Figure 20:
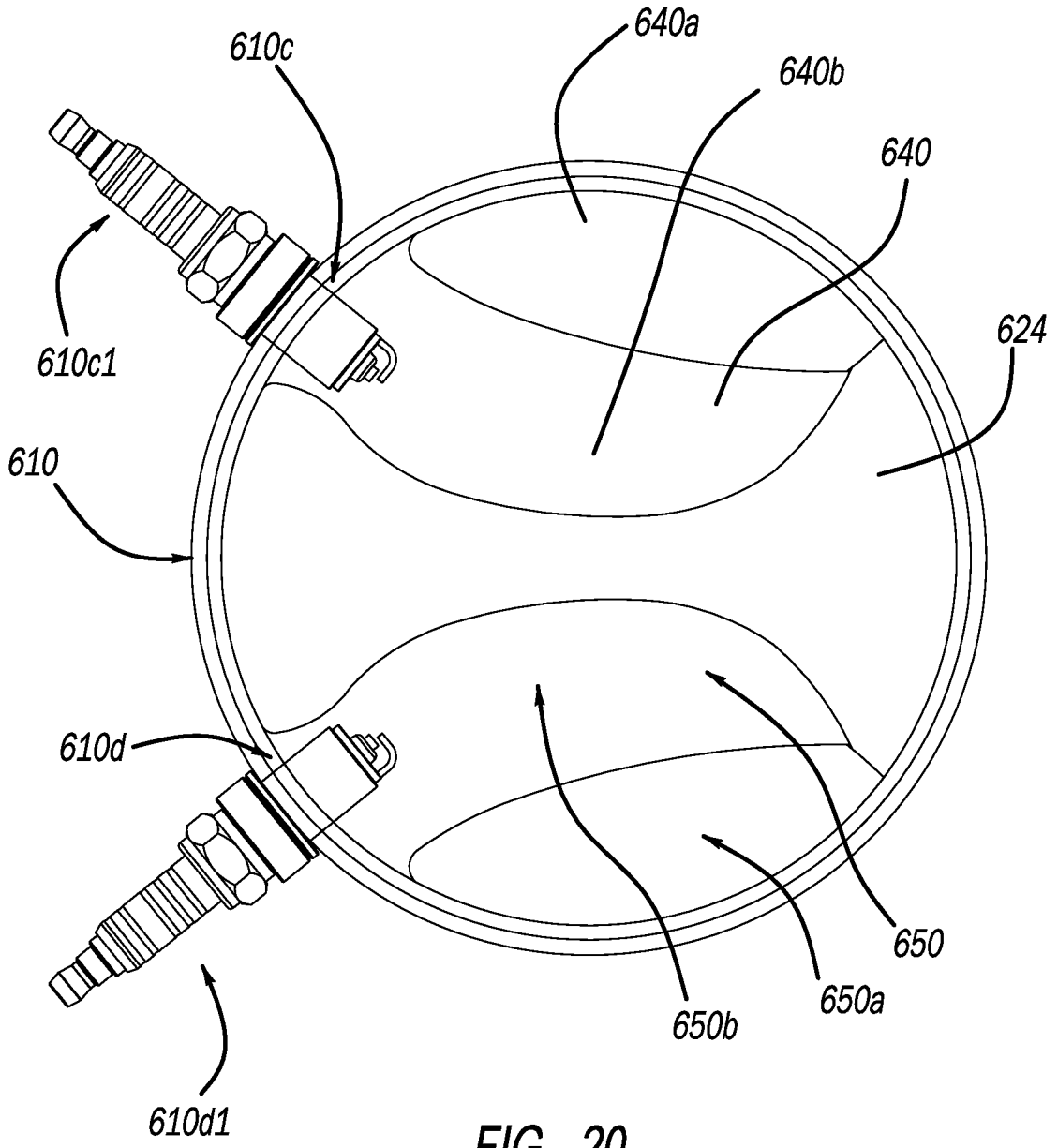
FIG. 20 illustrates an exemplary piston and piston face containing two ridges and two valleys, and two spark plugs contained within a first and a second valley.
Figure 22:
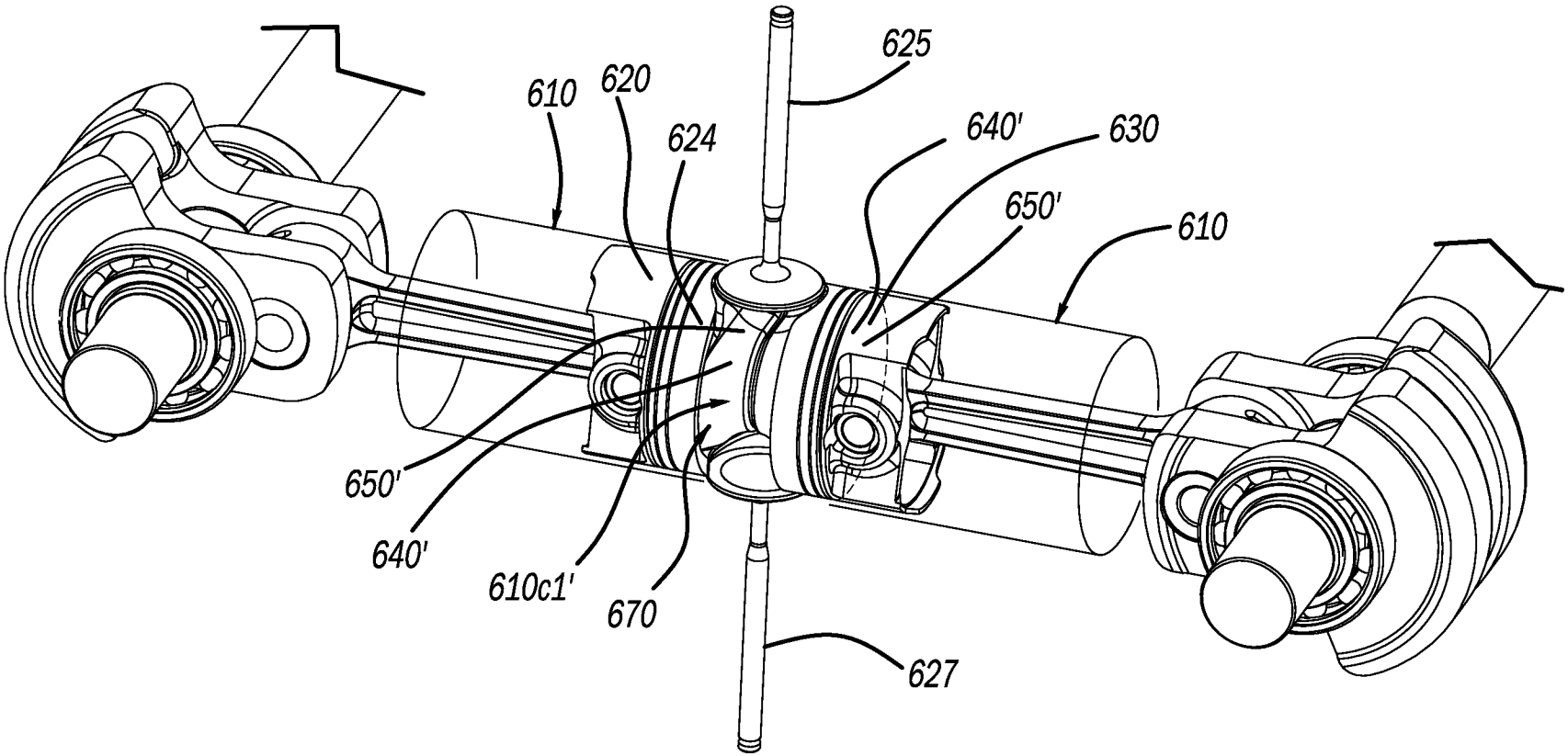
FIG. 22 illustrates a combustion chamber within a cylinder, as defined in accordance with the present invention.

As shown in FIG. 20 and FIG. 22, the piston face 624 has been formed to contain a first recess 640 and a second recess 650. A first spark plug 610*c*1 sits within a spark plug opening 610*c* within the cylinder 610, and at least partially extends into the first recess 640 to provide ignition of a combustive mixture within a combustion chamber 670 formed between two pistons shaped in the same manner. As shown in FIG. 20, first recess 640 contains a first ridge 640*a* and a first valley 640*b*, wherein the first spark plug 610*c*1 extends into the combustion chamber or valley 640*b*. In the same way, a second spark plug 610*d*1 sits within a spark plug opening 610*d* within the cylinder 610, and extends into the second recess 650 to provide ignition of a combustive mixture within a second combustion chamber 670 formed between two pistons shaped in the same manner.

As shown in FIGS. 21 and 22, the piston faces have been formed to contain a first recess 640' having several contours to form a desired combustion chamber 670. A first spark plug 610*c*1' is located at an edge of the combustion chamber to provide ignition to a combustion chamber 670' that extends across the diameter of the piston surface 624'. A second spark plug 610*d*1' is located across from the first spark plug 610*c*1', again at the edge of the chamber to provide ignition to a combustion chamber 670. The spark plugs are preferably symmetrically located across from each other. For example, as shown in FIG. 21, the first spark plug is located proximate to a four o'clock position of the piston surface and the second spark plug is located proximate to an eight o'clock position of the piston surface, wherein both positions occupy a portion of the recess described above.

In yet another aspect of an embodiment containing a first piston having a piston surface illustrated by FIG. 21, a first recess or a ridge 640' is formed and directly communicates with the first and second spark plugs. A second recess or a valley 650' is formed and directly and fluidly communicates with the exhaust port 627 and the intake port 625. The first recess 640' forms a ridge that is elevated above the second recess 650' or valley. A second piston (not shown) is formed in the same manner and when the first and second piston both reach top dead center (TDC) in the cylinder, a first volume 660 (not shown in FIG. 21)) is formed from the first recess of each piston coming together at TDC. Additionally, a second volume 662 (not shown in FIG. 21) is formed from the second recess of each piston coming together at TDC. It will be appreciated that in the embodiment exemplified by FIG. 21, the first volume is less than the second volume.

FIG. 22 illustrates a combustion chamber containing the first volume 660 and the second volume 662 of FIG. 21, whereby the two pistons 620 and 630 come together at TDC to thereby define an asymmetric or otherwise-shaped combustion chamber 670 within the cylinder 610.

It will be appreciated that the present invention essentially describes at least one channel or asymmetric shape being formed across the diameter of the piston, wherein the exhaust port and the intake port fluidly communicate with the channel containing gases (that is the combustion chamber) that are directed across the face of the piston during operation of an engine containing the piston. In the embodiment of FIG. 21 and FIG. 22, the ridge 640' and the valley 650' are believed to contribute to enhanced efficiency in evacuating the exhaust gases. It will be appreciated that in accordance with the present invention, it is believed that for a brief moment, the intake valve and the exhaust valves are both open at the same time. The enhanced exhaust efficiency contributed by the channel(s) as exemplified by the ridge and the valley of the piston of FIG. 21 and FIG. 22, is believed to create an enhanced movement and momentum of gases across the face of the piston. The vacuum created by the gases as they exit through the exhaust port is believed to create an enhanced draw of air through the simultaneously open intake port thereby enhancing the combustion process and relatively increasing the power per unit volume of the cylinder 610.

It will be appreciated that depending on the design criteria and the particular application of the engine, the ridge and valley of the piston face may vary in volume so that optimum efficiency in the flow of intake and combustion gases across the piston face is facilitated. In a preferred embodiment, the volume of the valley ranges from 1.25 to 10 times the volume of the ridge. One distinction of the present design is that the exhaust port and the intake port are in direct and unimpeded fluid communication with the channels (depicted by the ridge and valley of FIG. 21) for an instantaneous and brief period of time as the exhaust cycle is underway and the intake cycle is begun. This direct communication between the two ports creates an unimpeded vacuum, rather than a vacuum that must overcome a U-turn between the exhaust port and the intake port, for example, as seen in some engines. As a result, a substantially greater amount of air is drawn in through the intake port, by and through the momentum of the gases exiting the cylinder during the extremely brief overlap between the exhaust cycle and the intake cycle. Notwithstanding the various designs presented, the pistons need not be mirror images or symmetrical and can be designed independently of each other.

It will be appreciated that any type of combustible fuel may be used in accordance with the surface geometry of the piston to affect the present advantage in providing larger volumes of air for the combustion process. These fuels include gasoline, diesel, natural gas, methane, alcohol-based fuels, and so forth.

The piston face geometry may be formed by known methods and from known materials. For example, metal pistons may be formed by well-known metal-forming methods such as casting or extrusion methods. Exemplary related art includes U.S. Pat. Nos. 9,309,807, 5,083,530, and 9,163,505, each herein incorporated by reference in their entirety.

Exemplary Engine Embodiments

In one embodiment, crankshafts 540 and 542 are coupled to an associated gear train, generally designated 512. Gear train contains a first gear 512*a* fixed to the first crankshaft 540 about a medial portion 540' thereof, and further contains a second gear 512*b* fixed to the second crankshaft 542 about a medial portion 542' thereof. The gear train 512 further contains a third gear 512*c* with teeth enmeshed with the teeth of first gear 512*a*, and, a fourth gear 512*d* with teeth enmeshed with the teeth of second gear 512*b*. The teeth of third and fourth gears 512*c* and 512*d* are also enmeshed with each other, whereby the movement of any of gears 512*a*-512*d* causes a consequential movement of the remaining gears as shown in the Figures. In accordance with one embodiment of the present invention, the diameter d2 of the third and fourth gears 512*c* and 512*d* is twice the diameter d1 of first and second gears 512*a* and 512*b*, thereby resulting in a two to one ratio with regard to size of the inner gears 512*c* and 512*d* and the outer gears 512*a* and 512*b*. It will be appreciated that gears 512*a*-512*d* exemplify one drive mechanism, and that the drive mechanism 512 of the engine 500 may also be represented by a drive belts or drive chains, with the same size ratio between the respective driving elements of the belt or chain-driven drive mechanism.

In further accordance with the present invention, and in one embodiment of the present invention, the drive mechanism or gear train 512 converts rotational motion of the crankshafts to rotational motion of a first and second pair of cam discs 550, 550', 552, and 552'. Accordingly, the first pair of cam discs 550 and 552 are each rotationally and coaxially fixed and mounted to the exterior of the third gear 512*c*, such that the gear 512*c* and the associated pair of cam discs 550 and 552 all rotate at the same speed. In one embodiment, these cam discs 550 and 552 operate the inlet valves for each cylinder. In the same way, the second pair of cam discs 550' and 552' are each rotationally and coaxially fixed and mounted to the exterior of the fourth gear 512*d*, such that the gear 512*d* and the associated cam discs 550' and 552' all rotate at the same speed. In the same embodiment, these cam discs 550' and 552' operate the exhaust valves for each cylinder.

Figure 16:
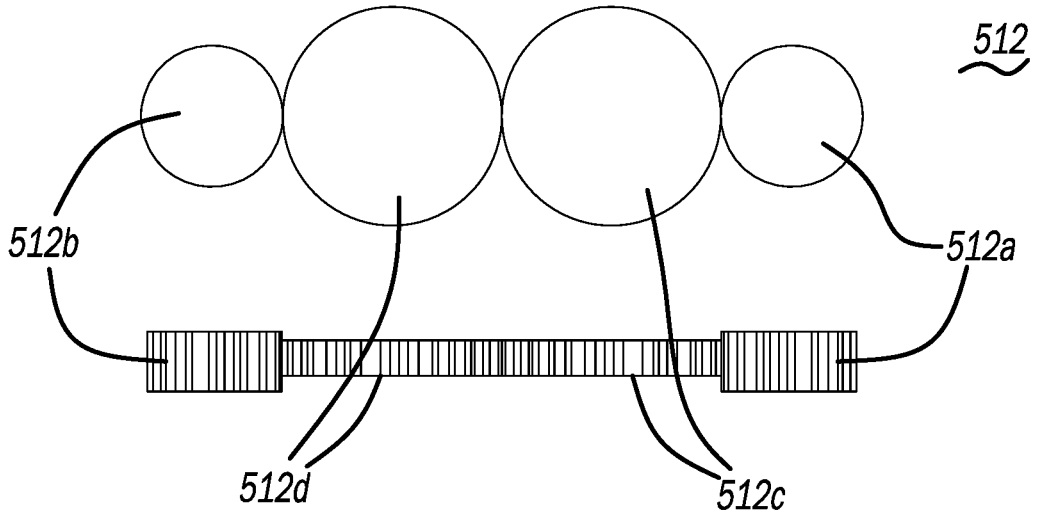
FIG. 16 illustrates a geared drive system of an exemplary engine of the present invention.
Figure 17:
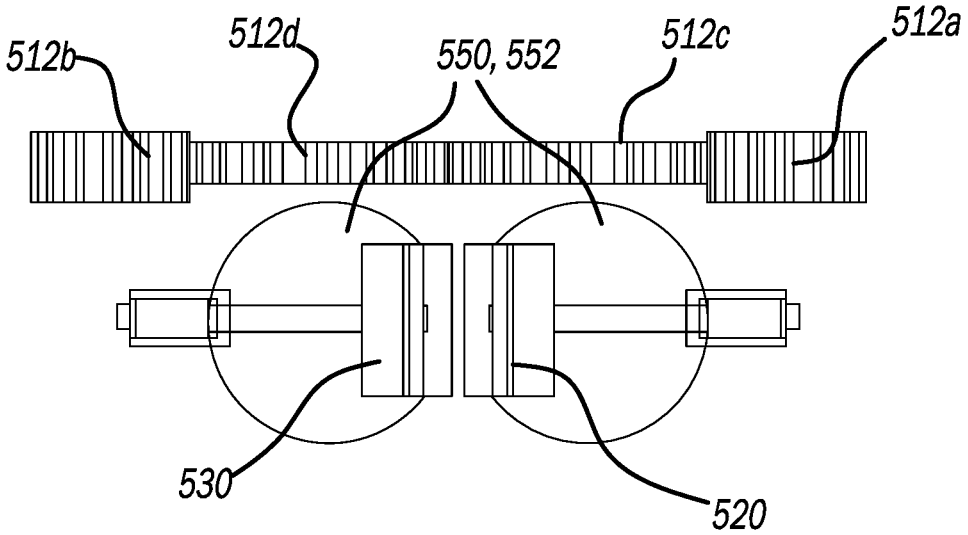
FIG. 17 illustrates a geared drive system of an exemplary engine of the present invention.

FIGS. 16 and 17 show a side view and a plan view of the gear train 512. Referring to FIGS. 16 and 17, in this particular embodiment, gears 512*a*, 512*b* connected to crankshafts 542, 540 (not shown in FIGS. 16 and 17) respectively, rotate at crankshaft speed but are reduced in size to serve as reducing gears. Thus, the rotational speeds of the gears 512*c* and 512*d* (and the rotational speeds of the cam discs 520, 522, 520', and 522' to which they are connected) are reduced to one half of the crankshaft speed.

Various elements of the vehicle and/or engine systems (for example, an oil pump or coolant circulation pump) may be operatively coupled to and powered by the gear train 512, via the gears in the gear train itself or via shafts and additional gears operatively coupled to the gear train. The coolant/cooling chamber surrounding the cylinders may be formed as known in the art or as otherwise described herein.

Referring again to FIGS. 1-9, the cam discs 550, 552, 550', and 552', are incorporated into the engine to actuate associated valve assemblies 530, 532, 534, and 536 which open and close to permit a flow of air to (and exhaust gases from) each cylinder combustion chamber 521 during operation of the engine. The cam discs 520, 522, 220', and 222' are mounted on the gears 512*c* and 512*d*, respectively, so as to be rotatable along with the gears 512*c* and 512*d*, and the elements are positioned so as to engage actuatable portions of the valve assemblies 530, 532, 534, 536 during cam rotation. More generally, the valve assemblies may be made as known in the art with regard to opposed piston engines. To illustrate, U.S. Pat. No. 7,779,795 is instructional and teaches exemplary valve assemblies, the teachings of which are incorporated herein by reference in their entirety.

Referring to FIG. 8, in one embodiment, each of camming elements or discs 550, 552, 550', and 552' includes one or more base portions 517 and one or more projecting portions 519 that project radially outwardly, the projection portions 519 contiguously connected to the base portions 517. Each base portion 517 defines a cam profile or surface 517*a*, 556 engageable with an actuatable portion of an associated valve assembly to produce a first state of the valve assembly. Each projecting portion 519 defines a cam profile or surface 519*a*, 556 engageable with the actuatable portion of the valve assembly to produce an associated alternative state of the valve assembly.

Figure 12:
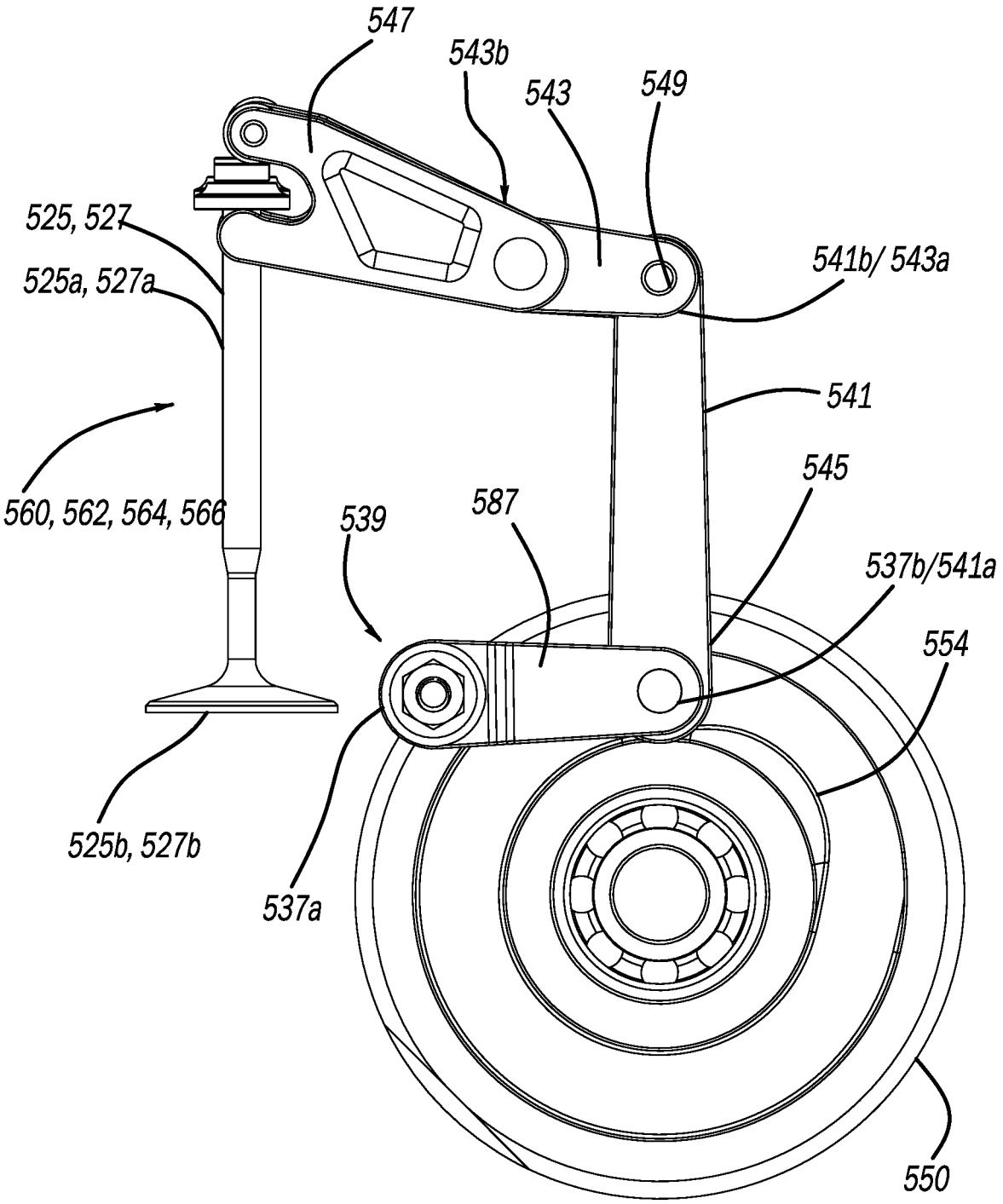
FIG. 12 illustrates an exemplary valve and cam assembly, in accordance with the present invention.
Figure 13:
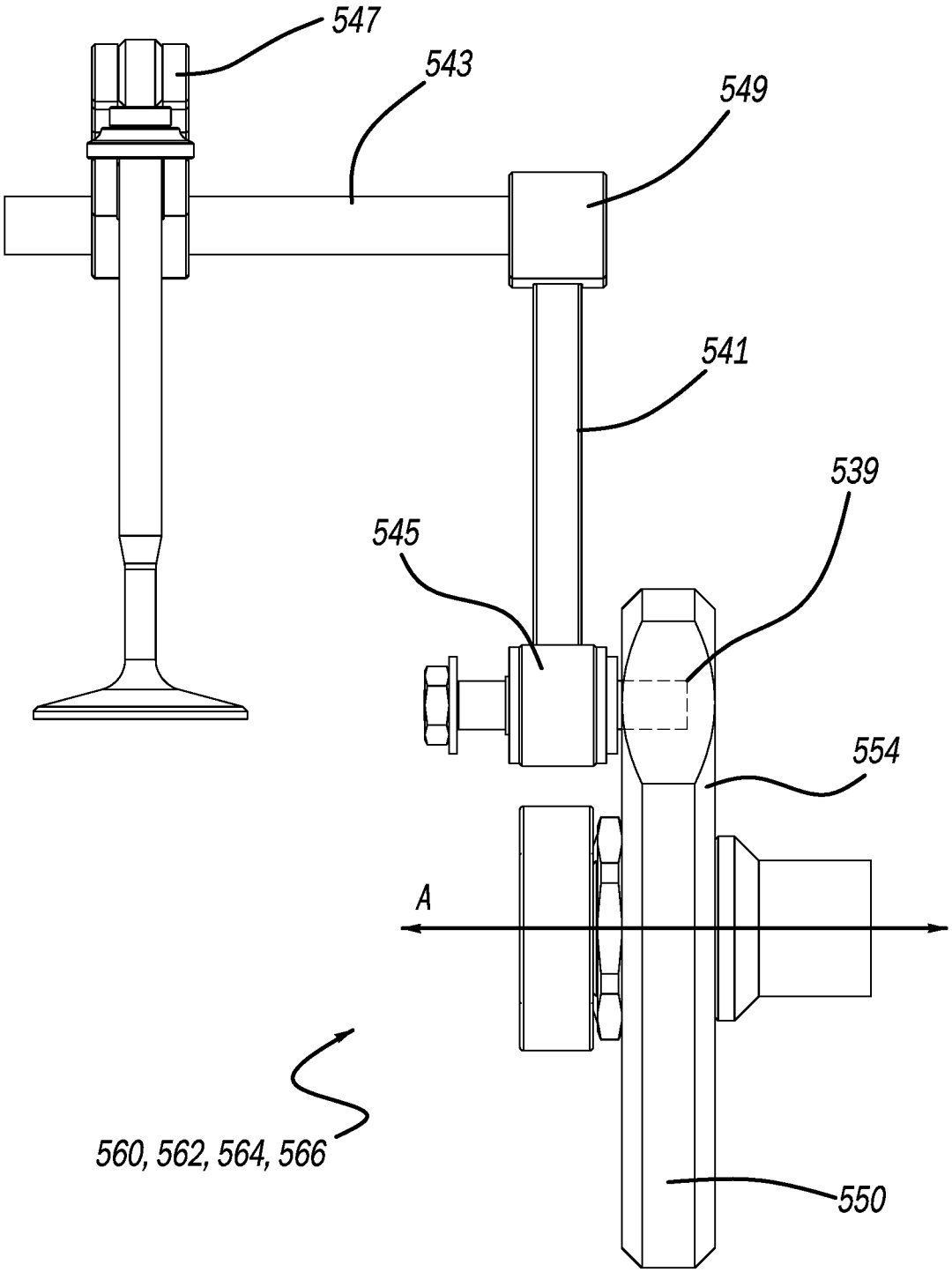
FIG. 13 illustrates a rear view of the valve and cam assembly of FIG. 12.

The valve assemblies 530, 532, 534, 536 of the present invention may be any applicable valve assembly. A preferred valve assembly is formed in a known manner as a Desmodromic valve assembly. As known in the art, a Desmodromic valve is a reciprocating engine valve that is positively closed by a cam and leverage system, rather than by a more conventional spring. Each Desmodromic valve assembly contains a plurality of connected armatures for actuation of an associated valve responsive to the cam groove of the cam disc. The width and the depth of the cam groove 554 may be tailored to affect the desired timing of the respective valve actuation. Alternatively, the cam disc 550-552' might itself be spooled inwardly toward the gear drive 512 or outwardly away from the gear drive 512 by known drivers, thereby obviating the need to vary the depth of the cam groove 554 to accomplish the same function. A first armature 537 of the valve assembly contains a cam follower 539 that traces the cam groove 554 as the cam disc 550-552' rotates responsive to the associated gear 512*c* or 512*d*. In general, the mechanism by which a camming surface engages a follower arm to actuate a rocker arm so as to open and close an associated poppet valve is known in the art, and the similar operation of the particular valve embodiments shown in the FIGURES to control flow into and out of the cylinder combustion chamber 521 are described herein. Referring to FIGS. 12 and 13, a spherical cam roller 539 is attached to a first end 537*a* of the first armature 537, and slidably engages the cam groove 554 as the cam disc 550, 550', 552, 552' (e.g. 550-552') rotates. A second armature 541 is pivotally engaged with a second end 537*b* of the first armature 537 at a first pivotable connection 545, whereby a ball joint, pin, or other pivoting means connects the second end 537*b* of the first armature 537 with a first end 541*a* of the second armature 541. The second armature 541 is substantially orthogonal or perpendicular to the first armature 537 during operation of the cam disc 550-552'. A third armature 543 is pivotally engaged with a second end 541*b* of the second armature 541 at a second pivotable connection 549, whereby a second ball joint, pin, or other pivoting means connects the second end 541*b* of the second armature 541 with a first end 543*a* of a third armature 543. The third armature 543 is substantially orthogonal or perpendicular to the second armature 541. A valve actuator 547 is fixed to a second end 543*b* of the third armature 543 and opens and closes the associated valve as the cam disc 550-552' rotates to provide a bias or pressure at the valve actuator end 543*b* of the third armature 543. Stated another way, as the cam disc 550/550' rotates from the base portions 517 through the projecting portions 519, a resultant torque or bias on the plurality of armatures cyclically affects a leverage on the rocker arm 547 thereby affecting the opening and closing of the associated valve 525/527.

A conventional poppet valve 525/527, has a conventional valve stem 525*a*/527*a* having a plug 525*b*/527*b* mounted to a first end 525*c*/527*c* of the stem, whereby the first end of the stem is fixed to the rocker arm or valve actuator 547. A valve seat 525*d*/527*d* is contained in the cylinder opening 510*a*/510*b* and functions as a valve guide and seat during operation of the four-stroke cycle. As indicated in the FIGURES, the valve 525/527 opens and closes as it vertically moves within the valve guide or valve seat 525*d*/527*d*. A corresponding detent or depression 520*a*/530*a*, collectively formed in the geometry of the dual-piston 520/530 interface at top dead center, provides a clearance for operation of the valve within the cylinder.

The base and projecting portions 517, 519 of the cam 550-552' are positioned and secured with respect to each other so as to form a continuous camming surface or profile 556 engageable by an associated actuatable valve element (such as a cam follower 539 as described above) as the cam disc 550-552' rotates. Thus, the actuatable valve element or cam follower 539 will alternately engage the cam base portion(s) 517 and any projecting portion(s) 519 as the cam 550-552' rotates.

In the embodiment shown in the FIGURES, the cam discs 550-552' or surfaces are arranged so as to reside on at least one side of the gears 512*c* and 512*d*. The projecting portions 519 of the cam disc 550-552' extend radially outwardly to a greater degree than the base portions 517 of the cam disc 550, 552. Thus, a portion of an actuatable valve element 539 engaging a base portion 517 of a cam will be forced radially outwardly when a cam projecting portion 519 rotates so as to engage the actuatable valve portion.

If desired, the size of the cylinder opening 510*a*, 510*b* leading into (or from) the combustion chamber 521 may be controlled by suitably dimensioning the radial distances of an associated portion of the cam profile with regard to the radial distances of the base portions 517 and the radial distances of the projecting portions 519 of the cam disc 550, 552. The amount of time or proportion of the engine cycle during which the valve is either open or closed may also be controlled by appropriately specifying the arc length occupied by the base portions 517 and projecting portions 519 of the cam profile 556. Transition of the valve assembly from a first state to a second state may be provided by a ramp or slope (or profile) 519*a* formed in part of the projecting portion 519.

Figure 8A:
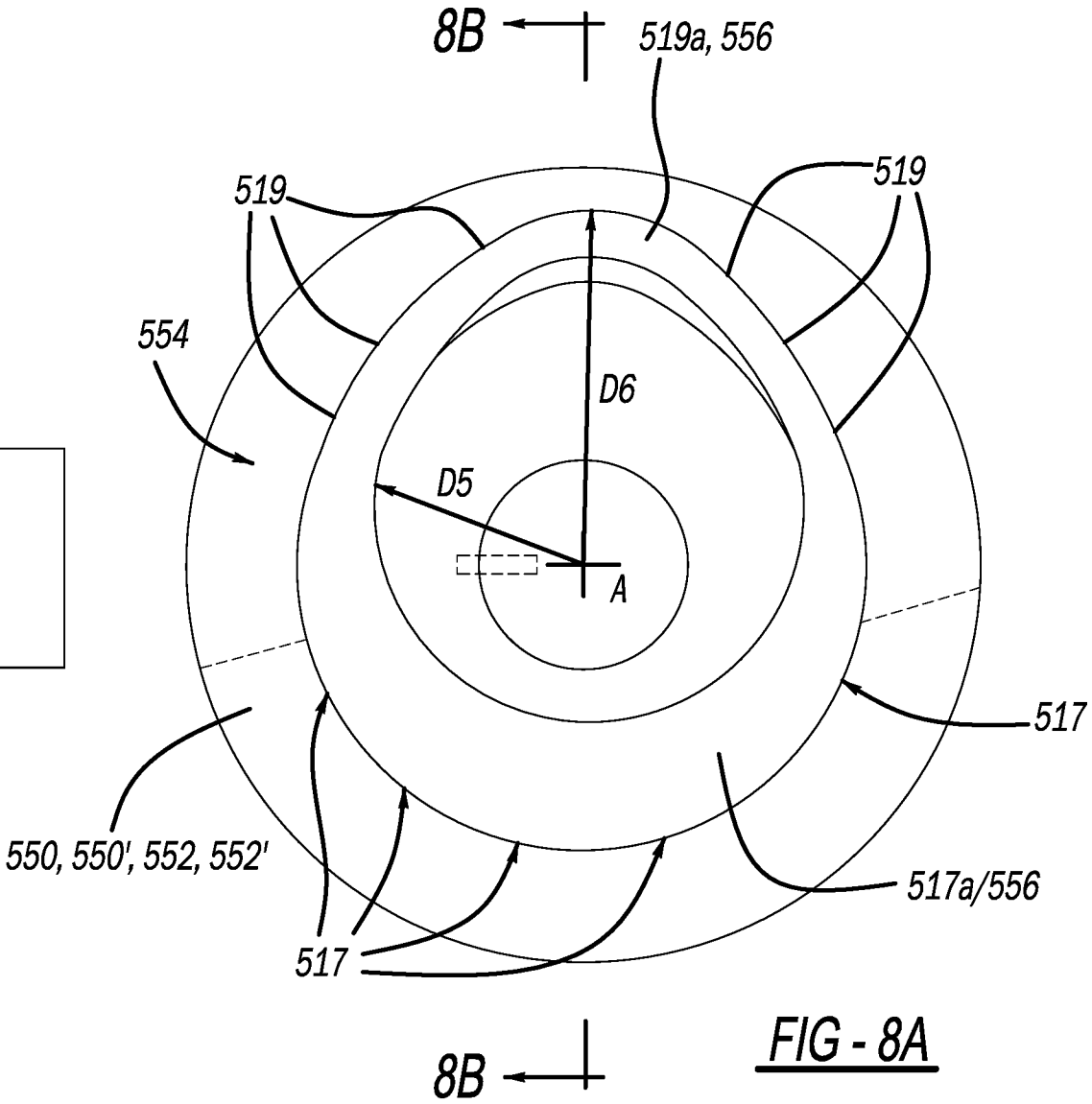
FIGS. 8A and 8B illustrate a Cam-Ring detail of one embodiment of the present invention.
Figure 8B:
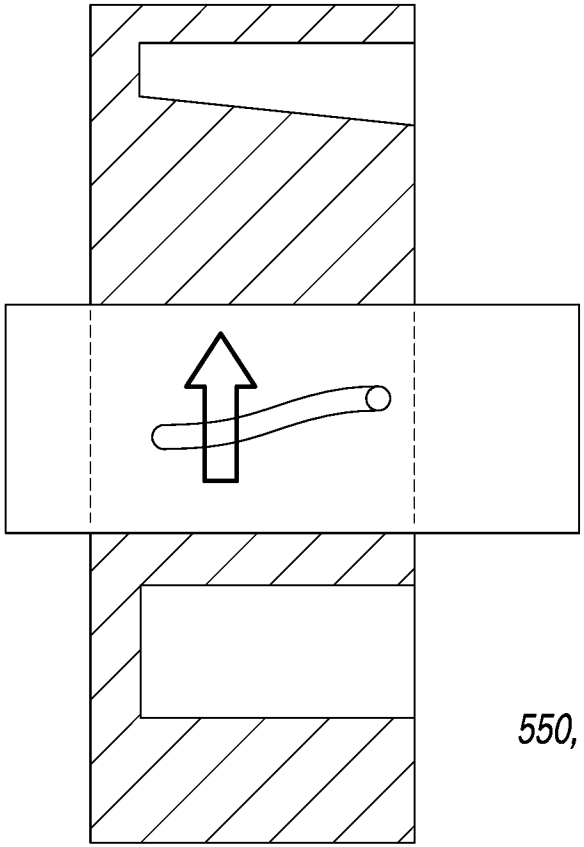

FIG. 8A illustrates an exemplary embodiment wherein the base portions 517 of the cam profiles 556 reside at equal radial distances from an axis A extending through the center of the cam disc 550,552, and wherein the projecting portions 519 of the cam profiles 556 reside at ramped radial distances, that is radial distances gradually increasing and then gradually decreasing toward and relative to the constant radial distances of the base portions 517. As seen in FIG. 8, the distances of the projecting portion profiles 519*a*, 556 from the rotational axis A of the cam disc 550-552' are greater than the distances of the base portion profiles 517*a*, 556 from the rotational axis A of the cam disc 550-552'. Thus, this embodiment provides two states (for example, "valve open" and "valve closed"), each state corresponding to a distance of one of the base portion profile or the projecting portion profile from the rotational axis A of the cam disc 550, 550', 552, 552', between which an associated valve assembly alternates during rotation of the cam 550-552'.

In other embodiments, any one of multiple intermediate states of the valve assembly may be achieved and maintained by providing cam projecting portions defining cam surfaces located at corresponding distances from the rotational axis A of the cam disc 550. All cam discs 550-552' essentially operate in the same manner. For example, in one embodiment, beginning at a point in the base projection, the intake valve 525 is opened as the exemplary cam disc 550 rotates 180 degrees from the beginning point, and the cam follower 539 cycle through greater radial distances as the disc 550 rotates through the projecting portions 519 of the disc, thereby defining the intake cycle of the four-stroke process. As the cam disc 550 continues to rotate, the intake valve 525 is closed as the cam disc 550 again approaches the base portions 517, and the compression cycle is conducted from about 181 degrees to 360 degrees of the rotation through the base portions 517 of the cam disc 550. As the cam disc 550 continues to rotate another 180 degrees for a total of 540 degrees, the expansion or combustion cycle is conducted, whereby both of the intake and exhaust valves 525, 527 are closed to seal the combustion chamber 521 during the expansion cycle. Finally, as the cam disc 550 rotates another 180 degrees for a total of 720 degrees of rotation, the exhaust cycle is completed whereby all exhaust gases exit the cylinder as they are shunted through the exhaust valve 527. Once the exhaust cycle is complete, the cam disc 550 then repeats the process to again rotate 720 degrees as the four-stroke process is repeated during the engine operation. In the embodiment shown in FIG. 8, a cam base portion surface 556 may be dimensioned to provide a closed state of the valve 525 or valve 527. In addition, a first projecting portion 519 having a camming surface 519*a* spaced a first radial distance D5 from the rotational axis A of the cam disc 550 when mounted on intermediate gear 512*c* (or 512*d*) may provide a "partially open" state of the valve 525 when engaged by an associated actuatable valve portion. Also, a camming surface 519*a*, 556 formed on projecting portion 219 (or on a separate projecting portion) and spaced a second radial distance D6 from the rotational axis A greater than the first distance D5 may provide a "fully open" state of the valve 525 when engaged by the actuatable valve portion. See FIG. 8A and FIG. 8B.

In a particular embodiment, when the actuatable portion or cam follower 539 of the valve assembly 530, 532, 534, or 536 engages and slides along the base portion(s) 517 of the cam profile 556, the associated valve assembly is in a closed condition (i.e., the valve assembly prevents flow of air into (or exhaust gases from) the cylinder combustion chamber 521. Also, when the cam follower or actuatable portion 539 of the valve assembly engages and slides along the projecting portion(s) 519, the valve assembly is in an open or partially open condition (i.e., the valve assembly permits flow of air into (or exhaust gases from) the cylinder combustion chamber 521.

The camming discs or elements 550-552' may be in the form of rings or other structures attachable to the exterior surface of the gears 512*c* and 512*d*. In a particular embodiment, the base and projecting portions 517 and 519, respectively, of the camming elements or discs 550, 550', 552, or 552', are modular in construction so that these elements may be changed out to provide any of a variety of cam profiles. In addition, the projecting portions of a cam profile may be changed out independently of the base portions of the profile. These options enable greater flexibility in control of the valve sequencing, enabling correspondingly greater control of the engine cycle.

Base portion(s) 517 and projecting portion(s) 519 may be attached to the cam disc 550 (or any other of the cam discs) using any suitable method, thereby creating a first arcuate region defined by the base portions 517 and a second arcuate region that is defined by ramped radial lengths of the projecting portions 519 as shown in FIG. 8A.

Because the projecting portion 519 actuating the valve 525 can be relocated so as to engage the valve 525 either sooner or later during rotation of the cam disc 550 (and, therefore, sooner or later in the engine cycle), the associated valve 525 may be opened or closed either sooner or later during the engine cycle. Thus, in one embodiment, the detachability and modularity of the camming elements 517 and 519 of the cam disc 550 may enable fine tuning of the engine cycle by adjustment of the valve actuation timing.

Alternatively, the cam discs 550, 550', 552, 552' may be formed as a machined monolithic disc wherein the respective cam groove 554 defined by the base portions 517 and projecting portions 519 may be altered by changing the entire cam disc 550 for one that has been machined to change the variability of the radial distances of the projecting portions 519, and perhaps the arcuate length of the base portions 517 and the projecting portions 519. The change in the design of the cam groove 554 therefore facilitates actuation of the valve 525 (or the valve 527) at a different point in the engine cycle and/or for a different length of time.

A follower 539 operatively connected to an associated valve 525 and valve 527 engages and follows the camming surfaces 556 of the disc 550 as the disc rotates. When the follower 539 reaches and engages a plurality of the ramped camming surface 519*a* residing in the projecting portions 519 of the cam disc 550 (as shown in FIG. 8), the follower 539 is raised as described elsewhere herein, causing the follower 539 or a pushrod coupled to the follower 539 to rotate a rocker arm 547, resulting in the opening of the valve 525 or 527, depending on where the follower 539 engages the cam groove 554. Accordingly, in this embodiment, one valve assembly 532 operable by cam disc 550 may be positioned below the engine to actuate a valve mechanism positioned beneath the engine, while another valve assembly operable by cam disc 550' is positioned above the engine to actuate a valve mechanism 534 positioned above the engine.

Figure 5:
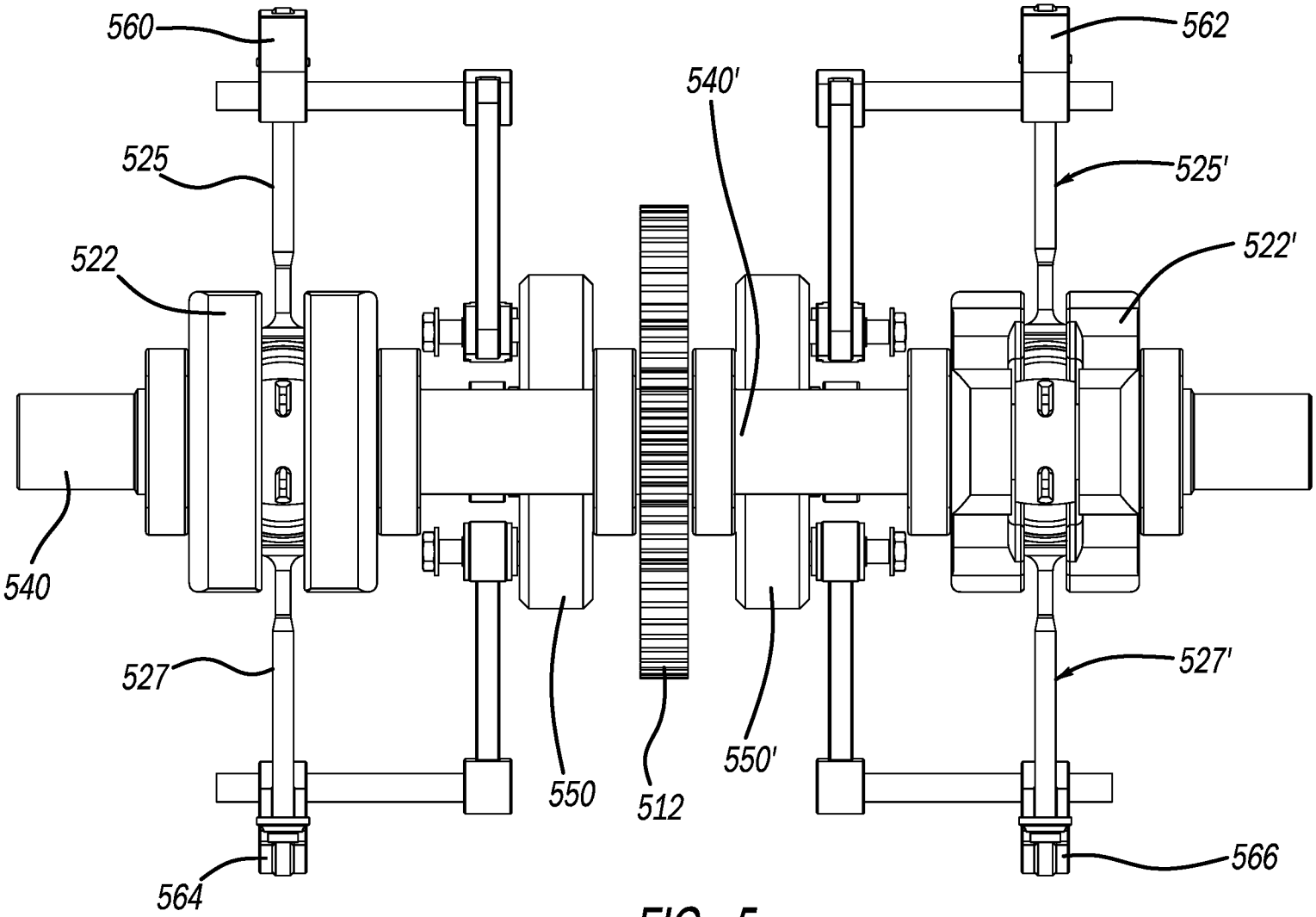
FIG. 5 is a rear view of preferred engine, in accordance with the present invention.

Referring to FIG. 5, in another embodiment, a cam disc 550 as previously described is mounted coaxially with gear 512*c* so as to rotate in conjunction with the gear 512*c*. Each cam disc and associated inner gear 512*c* or 512*d*, are operably oriented in this same configuration. In addition, the follower and/or other portions of the valve mechanism are oriented with respect to the cylinder housing such that the valve opens and closes as the follower 539 engages and follows the camming surfaces 556, as previously described.

FIGS. 1-5, illustrate a first embodiment of the present invention, and exemplifies the internal components of the cylinder and crankshaft housings (not shown in these FIGURES). A plurality of drive gears 512*a*, 512*b*, 512*c*, 512*d*, constitute an engine drive train 512. As shown, the teeth 512*e* of each respective gear is enmeshed, interlocked, or engaged with at least one of the juxtaposed and linearly-oriented drive gears 512*a*-512*d*.

A first crankshaft 540 is coaxially fixed to the first gear 512*a*, through medial portion 512*a'* of the first gear 512*a*. A first rod 522 is also coaxially fixed about a first end of the first crankshaft 540, and fixed to a first piston 520, for cycling the first piston 520 within a first cylinder 510. A second rod 522' is fixed about a second end of the first crankshaft 540, and fixed to a second piston 522', for cycling the second piston 522' within a second cylinder 510'. A third gear 512*c* is rotatably engaged with the first drive gear 512*a*. A first cam disc 550 and a second cam disc 550' are rotatably, coaxially, and concentrically oriented with, or fixed to, the third gear 512*c*, each cam disc about an opposite side of the gear 512*c*.

A first valve assembly 560 is fixed above the engine and operatively connected to the cam disc 550, for opening and closing of a first inlet valve 525 also operatively connected to the first valve assembly 560. A first valve seat 525*a* functions as a guide and a seat for the first valve 525 as the plurality of arms 537, 539, 541, and 543 of the first valve assembly 560 respond to the cam follower 539, as described above, to thereby actuate the first inlet valve 525 in conjunction with the cam profile 556 of the cam disc 550.

A second valve assembly 562 is fixed above the engine and is operatively connected to the cam disc 550', for opening and closing of a second inlet valve 525' also operatively connected to the second valve assembly 562. A second valve seat 525*a*' functions as a guide and a seat for the second inlet valve 525' as the plurality of arms 537, 539, 541, and 543 of the second valve assembly 562 respond to the cam follower 539, as described above, to thereby actuate the second inlet valve 525' in conjunction with the cam profile 556 of the cam disc 550'.

A second crankshaft 542 is coaxially fixed to the second gear 512*b*, through medial portion 512*b*' of the second gear 512*b*. A third rod 532 is also coaxially fixed about a first end of the second crankshaft 542, and fixed to a third piston 530, for cycling the first piston 530 within a first cylinder 510. A fourth rod 532' is fixed about a second end of the second crankshaft 542, and fixed to a fourth piston 530', for cycling the fourth piston 530' within the second cylinder 510'. A fourth gear 512*d* is rotatably engaged with the first drive gear 512*b* and the third drive gear 512*c*. A third cam disc 552 and a fourth cam disc 552' are rotatably, coaxially, and concentrically oriented with, or fixed to, the fourth gear 512*d*, each cam disc about an opposite side of the gear 512*d*.

A third valve assembly 564 is beneath the engine 500 and operatively connected to the cam disc 552, for opening and closing of a first exhaust valve 527 also operatively connected to the third valve assembly 564. A third valve seat 525*c* functions as a guide and a seat for the first exhaust valve 527 as the plurality of arms 537, 539, 541, and 543 of the third valve assembly 564 respond to the cam follower 539, as described above, to thereby actuate the first exhaust valve 527*a* in conjunction with the cam profile 556 of the cam disc 552.

A fourth valve assembly 566 is operatively connected to the cam disc 552', for opening and closing of a second exhaust valve 527' also operatively connected to the fourth valve assembly 535. A fourth valve seat 527*a*' functions as a guide and a seat for the second exhaust valve 527' as the plurality of arms 537, 539, 541, and 543 of the fourth valve assembly 566 respond to the cam follower 539, as described above, to thereby actuate the second exhaust valve 527' in conjunction with the cam profile 556 of the cam disc 550'.

Figure 6:
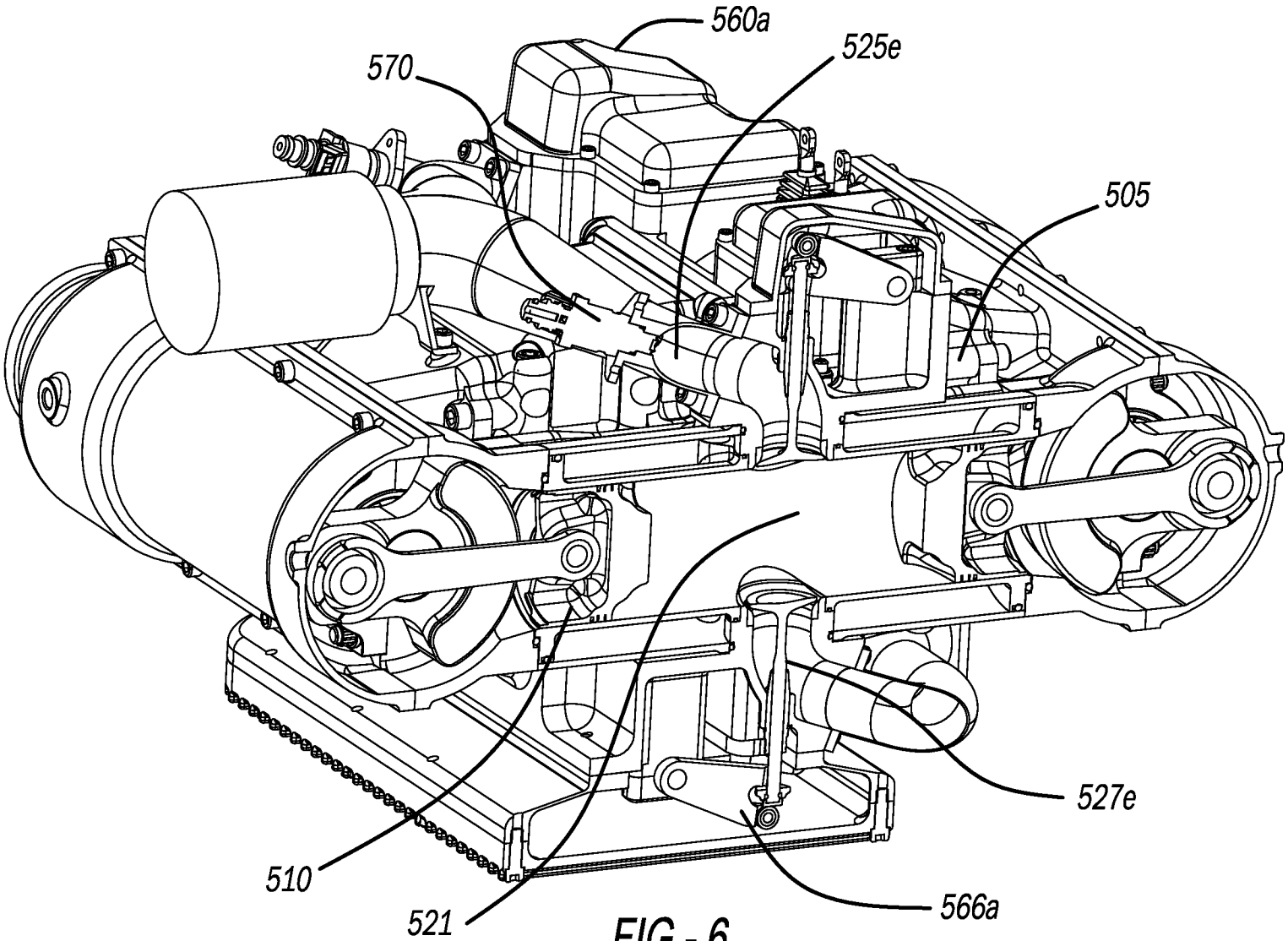
FIG. 6 is a cross-sectional view of two opposed pistons within an associated cylinder.
Figure 7:
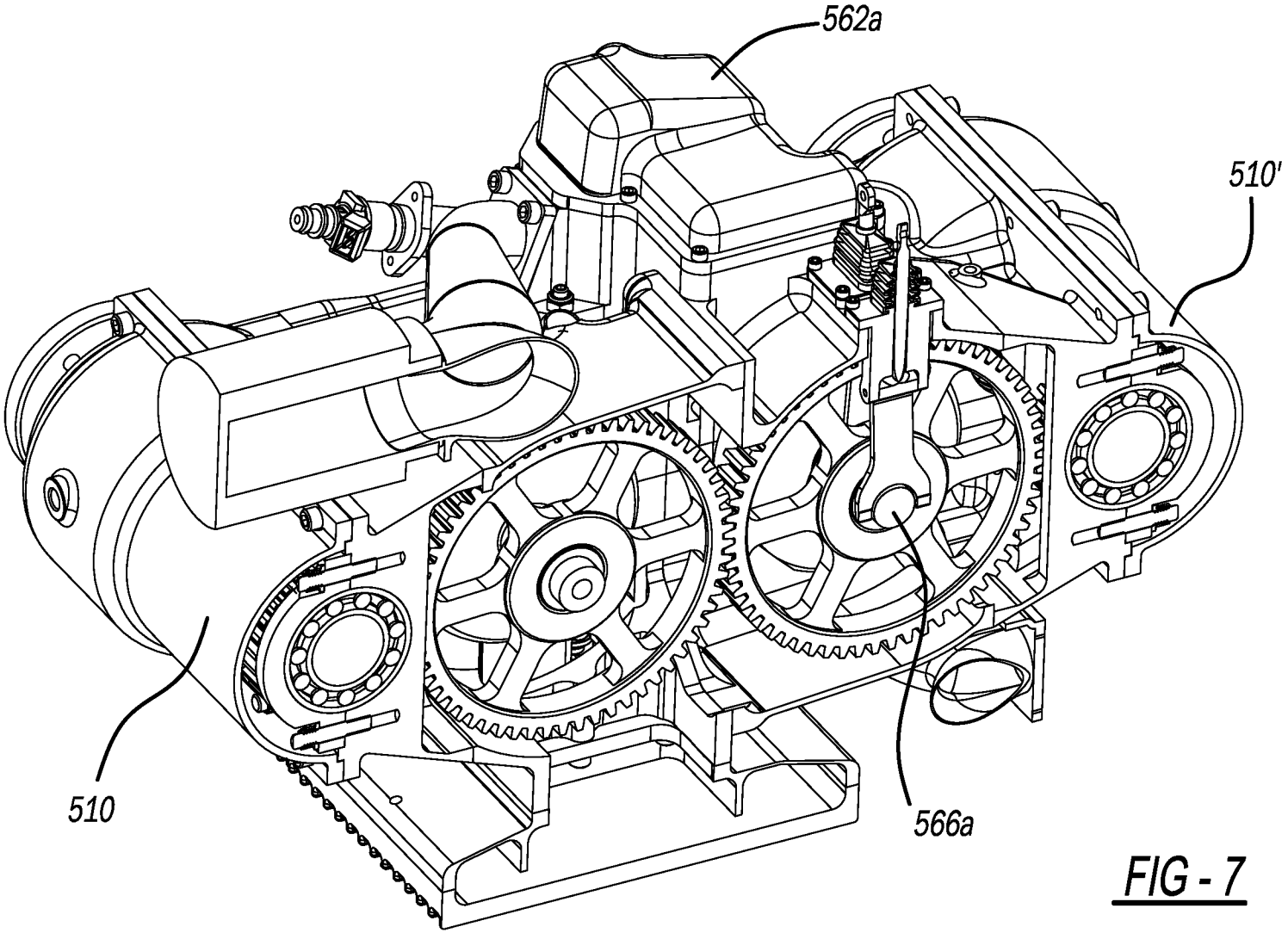
FIG. 7 is illustrates valve covers in a preferred engine.
Figure 9:
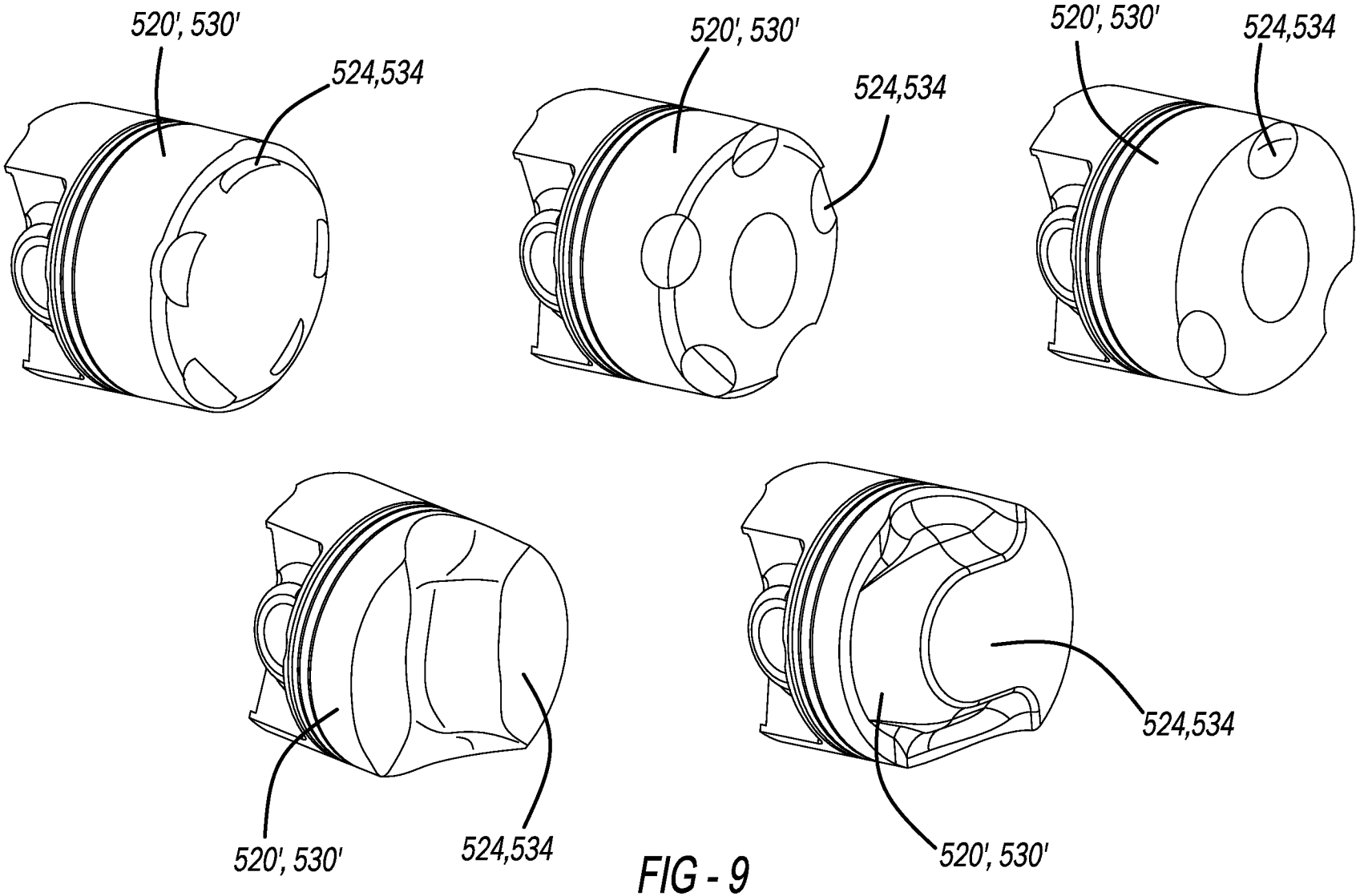
FIG. 9 illustrates various piston faces in accordance with the present invention.
Figure 10:
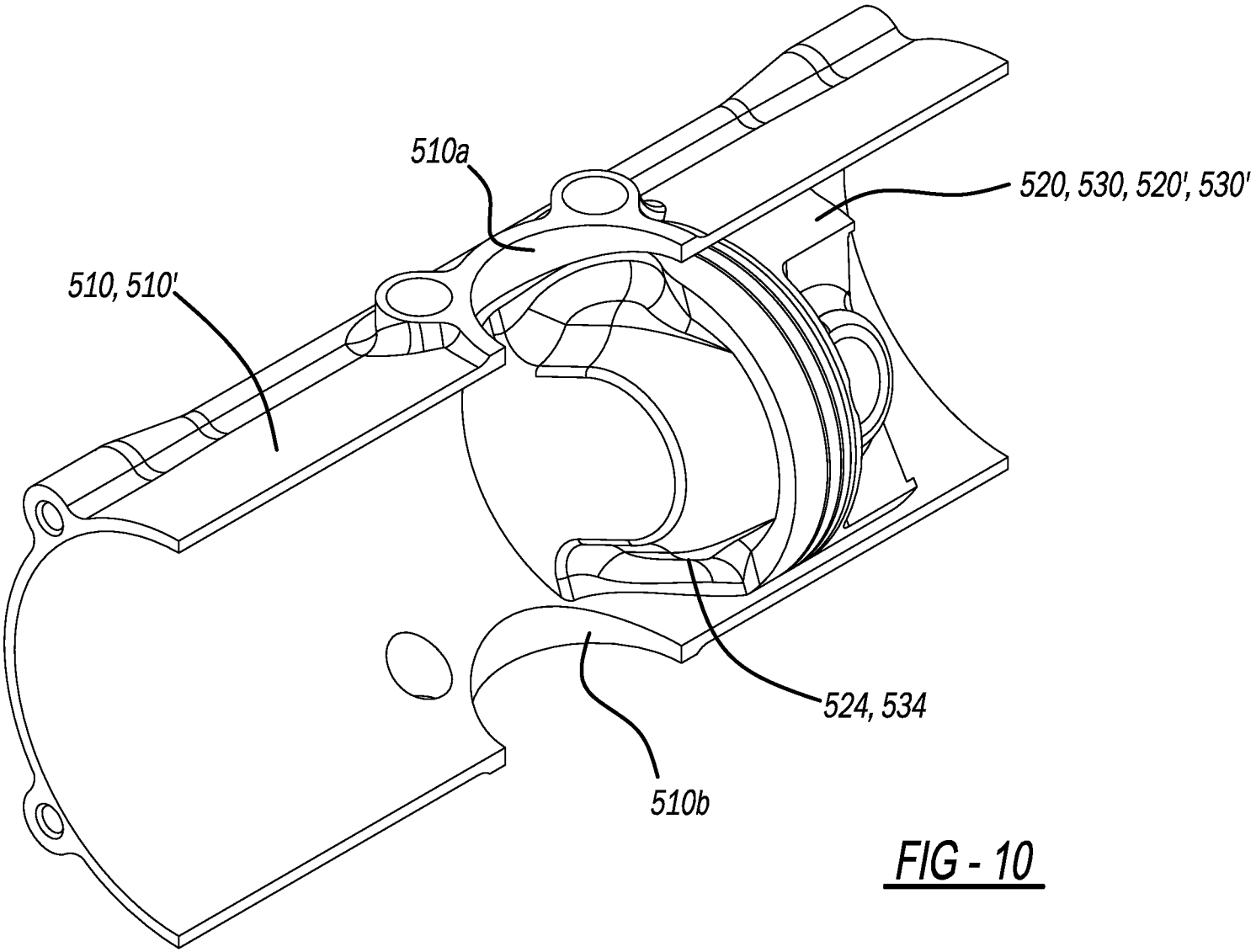
FIG. 10 illustrates a perspective cross-section of the combustion chamber and piston face in a preferred engine.

As shown in FIGS. 6 and 7, for example, each set of pistons and rods has a corresponding cylinder 510, 510' for providing a combustion chamber and for providing a sealed environment for the four-stroke engine process. As shown in FIG. 6, each inlet valve 525 has an inlet conduit 525*e* for providing inlet air to the engine during the inlet cycle. Each exhaust valve 527 has an exhaust conduit 527*e* for removing the exhaust gases from the cylinders during the exhaust cycle. Each cylinder 510, 510' has a spark plug that communicates with a central combustion chamber 521 formed between the piston caps 524,534 or interfaces when each of the pair of opposed pistons are at Top Dead Center (TDC). As shown in FIGS. 9-10, the piston caps or piston faces 524,534 may be varied in shape to provide a desired geometry of the combustion chamber 521. It has been found that providing a large central area of combustion in the combustion chamber 521 provides for more efficient combustion and more efficient communication with the spark plug initiator 570.

Figure 11A:
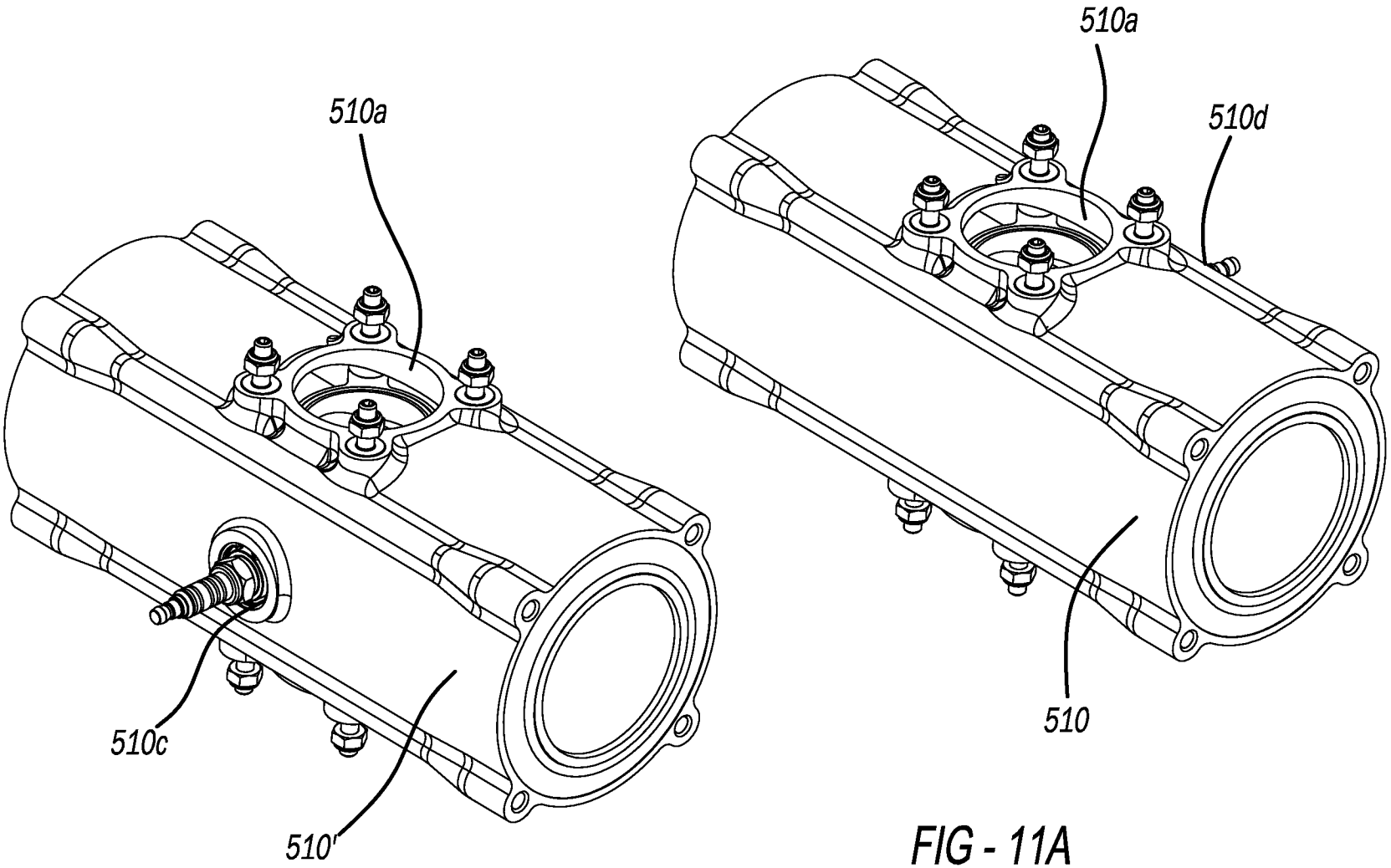
FIG. 11A illustrates two exemplary cylinders in accordance with the present invention.
Figure 11B:
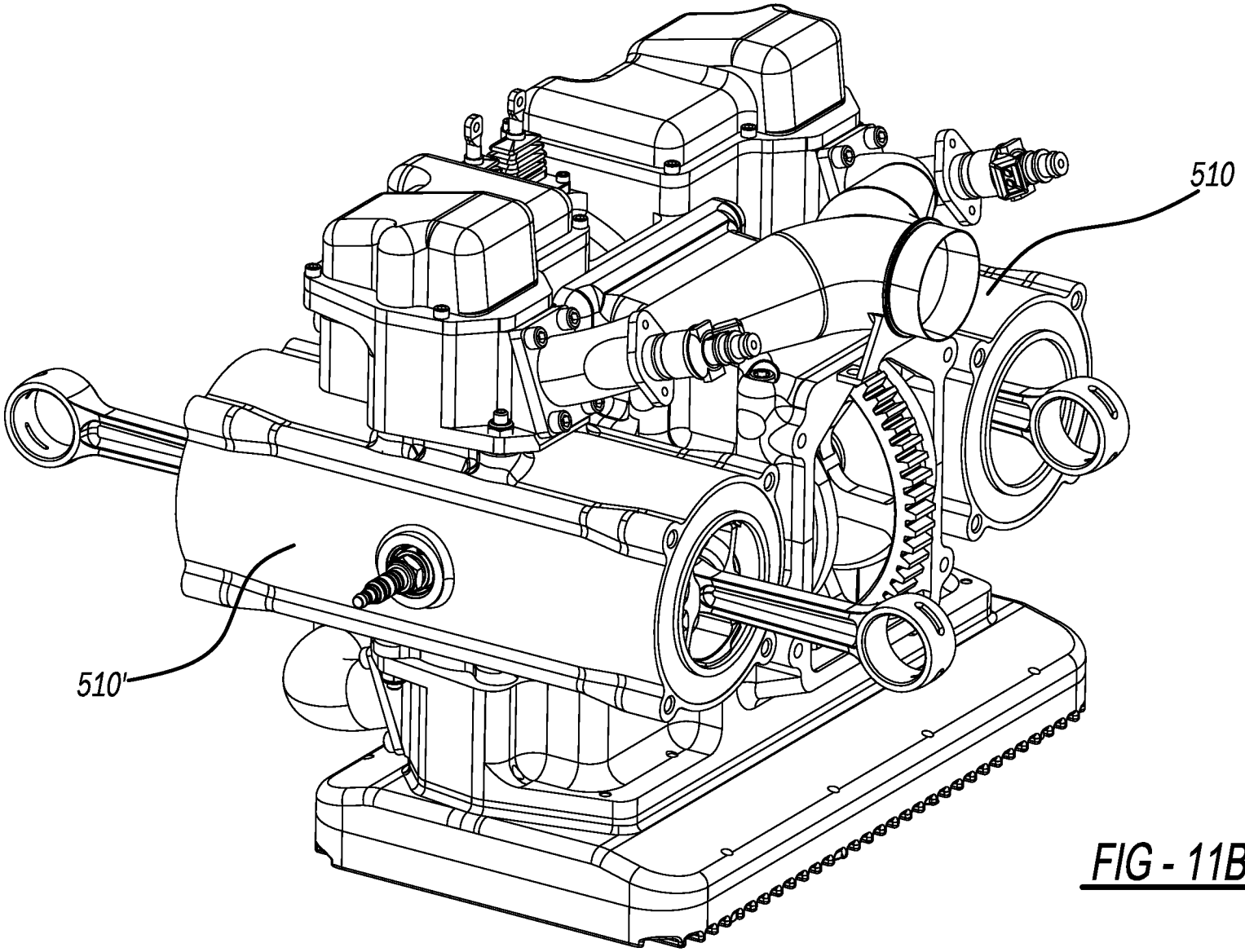
FIG. 11B illustrates two exemplary cylinders of FIG. 11A, with a valve assembly mounted thereon.

Other housing components of the engine 500 are illustrated in FIGS. 11A-13. FIG. 11A illustrates the cylinders 510, 510' containing cylinder openings 510*a* and 510*b*, and spark plug openings 510*c* and 510*d*. Spark plugs 510*c*1 and 510*d*1 are contained within the spark plug openings 510*c* and 510*d*, respectively. FIG. 11B illustrates the cylinders 510, 510' for housing the pistons, and, the valve housings 560*a*, 562*a*, 564*a*, 566*a*. FIGS. 12 and 13 provide a perspective view and a side view of the Desmodromic valve assembly, in accordance with the present invention. As shown in the FIGS. 12 and 13, the respective valve assembly and cam disc are shown in operative communication with each other. If desired, an overall engine housing (not shown) may be provided to cover the engine components.

Figure 14:
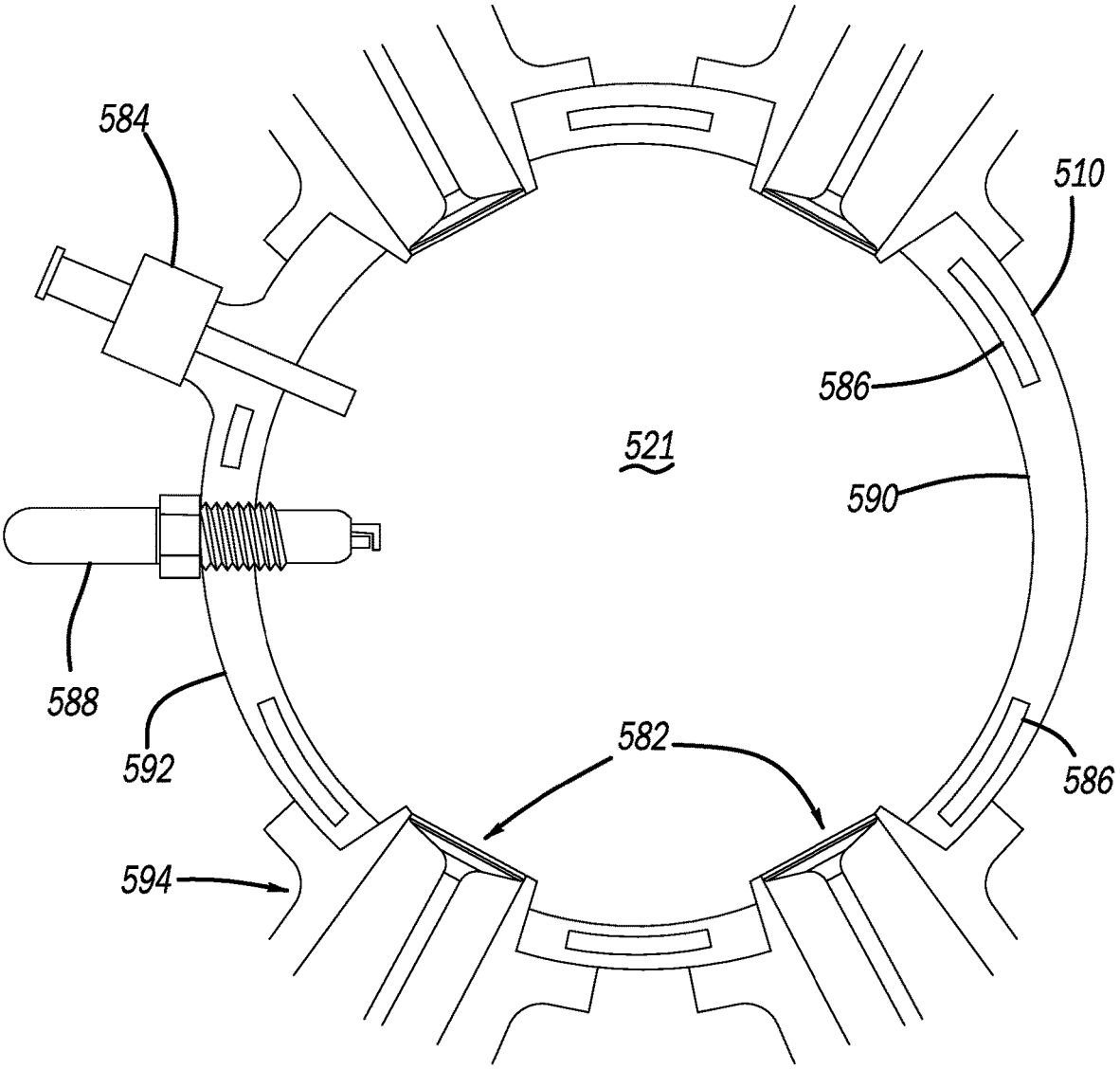
FIG. 14 illustrates an exemplary combustion chamber, in accordance with the present invention.
Figure 15:
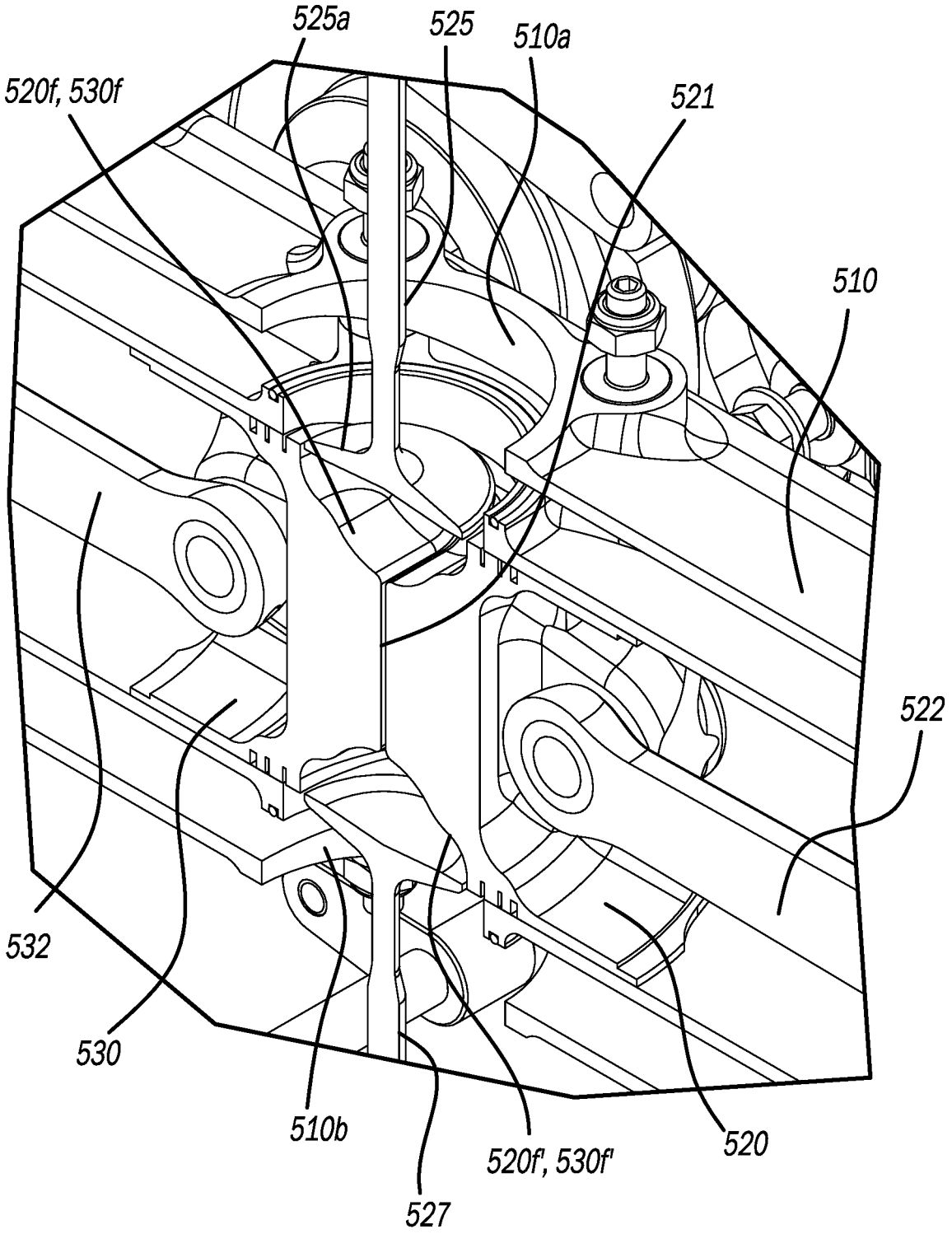
FIG. 15 illustrates two pistons at top dead center, in accordance with the present invention.

FIG. 14 schematically illustrates another embodiment of the present invention whereby a pair of intake valves 580 and a pair of exhaust valves 582 are actuated by corresponding valve assemblies (not shown). A fuel injector 584 and a coolant jacket 586 are also exemplified in FIG. 14 whereby the cylinder 510 is cooled by a suitable coolant as known in the art. A spark plug 588 may be centrally located to efficiently initiate the combustion process, in accordance with the present invention. An inner sleeve 590 and an outer sleeve 592 define the coolant jacket 586. A plenum 594 is defined about the exhaust valve 582. FIG. 15 in one embodiment, illustrates the interface of two opposed pistons whereby the piston cap interface at top dead center (TDC) forms a toroidal combustion chamber 521. The valves 525 and 527 are also seated within opposed detents or cavities 520*f*, 530*f*, 520*f*', 530*f*' formed in the top and bottom of the pistons, that when combined work to seal the valve/piston interface during the four-stroke process, and during operation of the valves as they open and close.

It should further be understood that the preceding is merely a detailed description of various embodiments of this invention and that numerous changes to the disclosed embodiments can be made in accordance with the disclosure herein without departing from the scope of the invention. The preceding description, therefore, is not meant to limit the scope of the invention. Rather, the scope of the invention is to be determined only by the appended claims and their equivalents.

What is claimed is:

1. An opposed-piston engine comprising:

a cylinder;

a first piston and a second piston opposed to said first piston, each piston contained within said cylinder, said first piston comprising a contoured, first piston face containing a first recess comprising a first ridge and a first valley, and said second piston comprising a contoured, second shaped piston face containing a second recess comprising a second ridge and a second valley, said contoured faces configured to allow clearance from radially inwardly extending intake and exhaust valves;

a combustion chamber defined by said first piston face and said second piston face in opposition to said first piston face, within said cylinder; and an ignition system comprising a first spark plug at least partially contained within said first ridge, and a second spark plug at least partially contained within said second ridge, wherein said ignition system is at least partially contained within said combustion chamber.

2. The opposed-piston engine of claim 1 further comprising at least one intake valve and at least one exhaust valve in operable to be in direct and unimpeded fluid communication with said combustion chamber when an exhaust cycle is under way and an intake cycle has begun.

3. The opposed-piston engine of claim 2 wherein said engine comprises a four-stroke engine and is operable to complete the intake cycle, a compression cycle, a combustion cycle, and the exhaust cycle.

4. The opposed-piston engine of claim 1 wherein said first recess comprises an hour-glass shaped recess, and, said second recess comprises a recess that complements, the hour-glass shaped first recess.

5. The opposed-piston engine of claim 1 wherein said first and second recesses comprise differently shaped recesses.

6. The opposed-piston engine of claim 1 wherein said first and second ridge comprise a first volume, and, said first and second valley comprise a second volume, wherein said second volume ranges from 1.5 to 10.0 times the amount of the first volume.

7. The opposed piston engine as in claim 1 wherein the engine comprises a four-stroke opposed-piston engine.

* * * * *